US007048804B2

(12) United States Patent
Kisela et al.

(10) Patent No.: US 7,048,804 B2
(45) Date of Patent: May 23, 2006

(54) SUCTION WET JET MOP

(75) Inventors: David Kisela, Cuyahoga Falls, OH (US); Richard C. Farone, Willoughby, OH (US); Steven D. Waldron, Courtland, OH (US); Michael F. Wright, Stow, OH (US); Craig M. Saunders, Rocky River, OH (US); Jeffrey M. Kalman, Cleveland Heights, OH (US); Lindsey Tufts, Jr., Euclid, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 83 days.

(21) Appl. No.: 10/669,214

(22) Filed: Sep. 24, 2003

(65) Prior Publication Data

US 2004/0139572 A1 Jul. 22, 2004

Related U.S. Application Data

(63) Continuation-in-part of application No. 10/340,691, filed on Jan. 10, 2003.

(51) Int. Cl.
*B08B 5/04* (2006.01)
*A47L 11/30* (2006.01)

(52) U.S. Cl. ..... 134/21; 15/320; 15/328; 15/403

(58) Field of Classification Search ..... 15/320, 15/328, 344, 363, 393, 403, DIG. 1; 134/21
See application file for complete search history.

(56) References Cited

U.S. PATENT DOCUMENTS

| | | | |
|---|---|---|---|
| 1,657,111 | A | 1/1928 | Desnoyers |
| 1,978,579 | A | 10/1934 | Hooks |
| 2,012,287 | A | 8/1935 | Replogle et al. |
| 2,064,903 | A | 12/1936 | Ghignatti |
| 2,091,290 | A | 8/1937 | Replogle |
| 2,470,837 | A | 5/1949 | Polson |
| 2,564,339 | A | 8/1951 | Nerheim |
| 2,821,733 | A | 2/1958 | Kasper |
| 2,873,465 | A | 2/1959 | Miller |
| 2,893,048 | A | 7/1959 | Martinec |
| 3,540,072 | A | 11/1970 | Wolter et al. |

(Continued)

FOREIGN PATENT DOCUMENTS

| | | |
|---|---|---|
| DE | 297 04 742 U | 10/1997 |

(Continued)

OTHER PUBLICATIONS

Patent Abstracts of Japan, vol. 1998, No. 13, Nov. 10, 1998 & JP 10 201697 A (Mizuno Akira; Nitto Denko Corp), Aug. 4, 1998.

*Primary Examiner*—Terrence R. Till
(74) *Attorney, Agent, or Firm*—Fay, Sharpe, Fagan, Minnich & McKee, LLP

(57) ABSTRACT

A cleaning device (10) includes a handle assembly (14). A cleaning head (12, 312, 512) is pivotally mounted to the handle assembly (14). The cleaning head selectively holds a cleaning pad (70) for collecting dust and debris from a surface to be cleaned. A suction nozzle (18) is carried by the cleaning head. A dirt collecting receptacle (208) is mounted to the housing and is in fluid communication with the suction nozzle and with a suction fan and motor assembly (30). At least one spray nozzle (22) is mounted on the suction nozzle. A liquid delivery system (90) delivers a cleaning fluid to the at least one spray nozzle.

56 Claims, 15 Drawing Sheets

U.S. PATENT DOCUMENTS 3,685,694 A 8/1972 Ianelli
3,833,962 A 9/1974 Krusche
4,172,710 A 10/1979 van der Molen
4,266,317 A 5/1981 Duda
4,635,315 A * 1/1987 Kozak ..... 15/329
4,665,582 A * 5/1987 Richmond et al. ..... 15/344
4,802,782 A 2/1989 Scalf
4,833,752 A 5/1989 Merrick
4,863,299 A 9/1989 Osberghaus et al.
4,976,465 A 12/1990 Gill et al.
5,020,186 A 6/1991 Lessig, III et al.
5,060,342 A 10/1991 Brazier
5,074,008 A 12/1991 Palomino, Jr.
5,107,567 A 4/1992 Ferrari et al.
5,167,045 A 12/1992 Rodriguez
D338,705 S 8/1993 Spokoiny
5,392,491 A 2/1995 Hwang et al.
5,399,381 A 3/1995 Randall
5,446,943 A * 9/1995 Sovis et al. ..... 15/350
5,461,749 A 10/1995 Ahlberg et al.
5,557,823 A 9/1996 Rouda
5,603,139 A 2/1997 Alazet
5,659,922 A 8/1997 Louis
5,713,103 A 2/1998 Keebler et al.
5,779,155 A 7/1998 Schennum et al.
5,779,745 A 7/1998 Kilstrom
5,784,755 A 7/1998 Karr et al.
5,842,504 A 12/1998 Schennum et al.
5,842,682 A 12/1998 Schennum et al.
5,875,926 A 3/1999 Schwartz
5,888,006 A 3/1999 Ping et al.
D409,343 S 5/1999 Kingry et al.
5,909,755 A 6/1999 Leal
5,924,167 A 7/1999 Wright et al.
5,960,508 A 10/1999 Holt et al.
5,988,920 A 11/1999 Kunkler et al.
6,000,088 A 12/1999 Wright et al.
6,003,191 A 12/1999 Sherry et al.
6,017,163 A 1/2000 Keppers et al.
D420,561 S 2/2000 Kunkler et al.
D423,742 S 4/2000 Kingry et al.
6,045,622 A 4/2000 Holt et al.
6,048,123 A 4/2000 Holt et al.
D425,274 S 5/2000 Kunkler
6,065,182 A 5/2000 Wright et al.
6,065,183 A * 5/2000 Hammeken et al. ..... 15/411
D427,401 S 6/2000 Kunkler
D428,226 S 7/2000 Kunkler
6,095,370 A 8/2000 Rhine et al.
6,101,661 A 8/2000 Policicchio et al.
6,101,668 A 8/2000 Grey
D432,747 S 10/2000 Kunkler
6,134,744 A 10/2000 Kasen et al.
6,142,750 A 11/2000 Benecke
6,146,434 A 11/2000 Scalfani et al.
6,206,058 B1 3/2001 Nagel et al.
6,243,909 B1 6/2001 Graham et al.
6,243,912 B1 * 6/2001 Grey ..... 15/320
6,298,517 B1 10/2001 McKay
6,305,046 B1 10/2001 Kingry et al.
6,321,941 B1 11/2001 Argentieri et al.
6,328,543 B1 12/2001 Benecke
6,334,233 B1 1/2002 Roberts et al.
6,347,428 B1 2/2002 Shimko et al.
6,353,964 B1 3/2002 Andrisin, Jr. et al.
6,380,151 B1 4/2002 Masters et al.
6,386,392 B1 5/2002 Argentieri et al.
6,390,335 B1 5/2002 Lawson et al.
D458,427 S 6/2002 Kunkler et al.
D458,722 S 6/2002 Romero et al.
6,458,442 B1 10/2002 McKay
6,474,896 B1 11/2002 DeLaine, Jr.
6,484,346 B1 11/2002 Kingry et al.
6,491,069 B1 12/2002 Nagel et al.
6,540,424 B1 4/2003 Hall et al.
6,550,092 B1 4/2003 Brown et al.
6,550,639 B1 4/2003 Brown et al.
6,551,001 B1 4/2003 Aberegg et al.
6,559,116 B1 5/2003 Godfroid et al.
6,571,421 B1 * 6/2003 Sham et al. ..... 15/320
6,572,711 B1 * 6/2003 Sclafani et al. ..... 134/21
6,601,261 B1 8/2003 Holt et al.
6,629,332 B1 * 10/2003 Morgan et al. ..... 15/320
D487,324 S 3/2004 Santiago et al.
2001/0029966 A1 10/2001 Wong et al.
2001/0046407 A1 11/2001 Kunkler et al.
2001/0047559 A1 12/2001 Graham et al.
2001/0051479 A1 12/2001 Fereshtechkou et al.
2002/0011531 A1 1/2002 DiMaggio et al.
2002/0042962 A1 4/2002 Willman et al.
2002/0050016 A1 5/2002 Willman et al.
2002/0066153 A1 6/2002 Sclafani et al.
2002/0066747 A1 6/2002 Argentieri et al.
2002/0166573 A1 11/2002 Policicchio et al.
2002/0168216 A1 11/2002 Policicchio et al.
2002/0175092 A1 11/2002 Stulens et al.
2002/0179635 A1 12/2002 Incardona et al.
2002/0183233 A1 12/2002 Mitra et al.
2002/0184726 A1 12/2002 Kingry et al.
2002/0186996 A1 12/2002 Miller
2003/0003831 A1 1/2003 Childs et al.
2003/0003832 A1 1/2003 Childs et al.
2003/0009839 A1 1/2003 Streutker et al.
2003/0028988 A1 2/2003 Streutker et al.
2003/0034050 A1 2/2003 Policicchio et al.
2003/0034084 A1 2/2003 Nagel et al.
2003/0042330 A1 3/2003 Streutker et al.
2003/0044569 A1 3/2003 Kacher et al.
2003/0045197 A1 3/2003 Kakiuchi et al.
2003/0049407 A1 3/2003 Kacher et al.
2003/0052204 A1 3/2003 Aberegg et al.
2003/0074756 A1 4/2003 Policicchio et al.
2003/0074796 A1 4/2003 Lewis
2003/0095826 A1 5/2003 Policicchio et al.
2003/0126709 A1 7/2003 Policicchio et al.
2003/0126710 A1 7/2003 Policicchio et al.
2003/0127108 A1 7/2003 Policicchio et al.
2003/0133740 A1 7/2003 Policicchio et al.
2004/0031121 A1 2/2004 Martin et al.
2004/0045126 A1 * 3/2004 Parker et al. ..... 15/403
2004/0134025 A1 * 7/2004 Murphy et al. ..... 15/403
2004/0139572 A1 * 7/2004 Kisela et al. ..... 15/320
2005/0076468 A1 * 4/2005 Matousek et al. ..... 15/403

FOREIGN PATENT DOCUMENTS

DE 201 03 268 U1 6/2001
EP 0 370 698 A1 5/1990
EP 0 477 588 6/1995
EP 0 625 331 B1 8/1997
EP 1 027 855 A2 8/2000
GB 741 136 A 11/1955
GB 2 078 496 A 6/1981
JP 10-14829 * 1/1998
WO WO 98/23200 6/1998
WO WO 00/27271 5/2000
WO WO 00/63333 10/2000
WO WO 01/10563 2/2001
WO WO 01/10768 2/2001
WO WO 01/22860 4/2001
WO WO 01/22861 4/2001
WO WO 01/40101 6/2001
WO WO 01/72195 10/2001

* cited by examiner

SUCTION WET JET MOP

This application claims the benefit, as a continuation-in part, of U.S. application Ser. No. 10/340,691, filed on Jan. 10, 2003, the specification of which is incorporated herein in its entirety by reference.

BACKGROUND OF THE INVENTION

1. Field of the Invention

The present invention relates to floor care devices. More particularly, the present invention relates to a combined floor mop and vacuum suction device.

2. Discussion of the Art

A wide variety of products exist which are capable of cleaning hard surfaces, such as ceramic tile floors, hardwood floors, and the like. Many of these products comprise a directing handle and a sponge for absorbing a fluid cleaning composition. The sponge is rinsed periodically to remove dirt, soil, and other residues. These products are not designed to handle larger particulate material such as crumbs and the like. Such materials are removed either by use of a broom or by use of a vacuum cleaner.

Non-woven sheets have been used for dry dust-type cleaning, as disclosed, for example, in U.S. Pat. Nos. 3,629,047 and 5,144,729. The sheets are designed to attract particulate dirt electrostatically and minimize the amount of residue left on the surface being wiped.

Recently, cleaning tools have been developed with disposable cleaning pads for removal of dirt from damp surfaces. For example, U.S. Pat. No. 5,094,559 describes a mop that includes a disposable cleaning pad comprising a scrubber layer for removing dirt from a soiled surface, a blotter layer for absorbing fluid after the cleaning process, and a liquid impervious layer positioned between the scrubber and blotter layers. During the cleaning action with the scrubber layer, the impervious sheet prevents fluid from moving to the absorbent blotter layer. After the cleaning action is completed, the pad is removed from the mop handle and reattached such that the blotter layer contacts the floor. This operation is time consuming for the user and involves the handling of a soiled, wet pad.

U.S. Pat. No. 5,419,015 describes a mop having removable, washable work pads. Each pad has an upper layer, which is capable of attaching to hooks on a mop head, a central layer of synthetic plastic microporous foam, and a lower layer for contacting a surface during the cleaning operation.

However, such tools are designed for light floor cleaning and are unsuited to handle large particles of dirt, such as pebbles, crumbs, and the like. There remains a need for a single device that is capable of removing quantities of dry dirt and larger particles, crumbs and the like from a floor surface and also of performing wet cleaning of the surface.

The present invention provides a new and improved floor cleaning device and method of use, which overcome the above-referenced problems and others and meet the above-stated needs.

SUMMARY OF THE INVENTION

In accordance with one aspect of the present invention, a cleaning device is provided. The device includes a handle assembly. A cleaning head is pivotally attached to a first end of said handle assembly and configured for receiving a replaceable cleaning pad for collecting dirt from a floor surface to be cleaned. A spray nozzle is mounted on one of said cleaning head and the handle assembly for delivering a cleaning fluid to a floor surface to be cleaned. A liquid delivery system delivers cleaning fluid to the spray nozzle. At least a portion of the liquid delivery system is carried by the handle assembly. A suction nozzle is carried by the cleaning head. A dirt collection assembly is provided for collecting dirt and is in fluid communication with the suction nozzle. The dirt collection assembly is carried by one of the handle assembly and the cleaning head. A source of suction is carried by one of the handle assembly and the cleaning head. The source of suction is fluidly connected with the dirt collection assembly for creating a flow of working air which draws dirt from the suction nozzle into the dirt collection assembly.

In accordance with another aspect of the present invention, a cleaning device is provided. The device includes a housing. A suction fan and motor assembly is mounted to the housing. A cleaning head is pivotally mounted to the housing. The cleaning head selectively holds a cleaning pad for collecting dust and debris from a surface to be cleaned. A suction nozzle is carried by the cleaning head. A dirt collecting receptacle is mounted to the housing and is in fluid communication with the suction nozzle and the suction fan and motor assembly. At least one spray nozzle is disposed on at least one of the suction nozzle and the cleaning head. A liquid delivery system is provided for delivering a cleaning fluid to the at least one spray nozzle. At least a portion of the liquid delivery system is mounted on the housing.

In accordance with another aspect of the present invention, a cleaning device is provided. The cleaning device includes a cleaning head selectively holding a cleaning pad. A handle is provided for directing the cleaning head along a surface to be cleaned. A housing is mounted to at least one of the handle and the cleaning head. A suction fan and motor assembly is mounted to the housing. A dirt collecting receptacle is mounted to the housing. A suction nozzle is fluidly connected with the dirt collecting receptacle. A liquid delivery system is mounted to at least one of the housing and the suction nozzle for delivering a cleaning solution to the surface to be cleaned. The liquid delivery system includes a spray nozzle carried by one of the suction nozzle, the handle, and the cleaning head.

In accordance with another aspect of the present invention, a cleaning device is provided. The device includes a housing and a suction nozzle communicating with the housing. A suction fan and motor assembly is mounted to the housing. A dirt collecting receptacle is mounted to the housing and is in fluid communication with the suction nozzle and the suction fan and motor assembly. A liquid delivery system is mounted to the housing for delivering a cleaning solution to a surface to be cleaned. A handle is mounted to the housing for grasping to move the cleaning device along the surface to be cleaned. A switch is provided for actuating at least one of the suction fan and motor assembly and the liquid delivery system. A cleaning head is pivotally mounted to the housing, the cleaning head selectively holding a cleaning pad for collecting dust and debris from a surface to be cleaned.

In accordance with another aspect of the present invention, a cleaning device is provided. The device has two separate and distinct modes of operation. A first mode of operation comprises suctioning debris from a surface to be cleaned. A second mode of operation comprises application of a cleaning liquid to the surface. A cleaning pad is used to collect dirty cleaning liquid and dust and debris from the surface to be cleaned. The device includes a housing. A suction fan and motor assembly is mounted to the housing. A dirt collecting receptacle is mounted to the housing. A suction nozzle is fluidly connected with the suction fan and motor assembly and the dirt collecting receptacle for performing the first mode of operation. A liquid delivery system is mounted at least in part to the housing for delivering a cleaning liquid to the surface during the second mode of operation. A cleaning head is pivotally mounted to the housing. The cleaning head selectively holds the cleaning pad used during the second mode of operation.

In accordance with another aspect of the present invention, a cleaning device is provided. The device has a liquid delivery system for cleaning a surface. An elongate handle assembly has first and second ends. A cleaning head is pivotally mounted to the first end of the handle assembly. A cleaning pad is mounted to the cleaning head for collecting dirty cleaning liquid and dust and debris from a surface to be cleaned. A suction nozzle is carried by one of the cleaning head and the elongate handle assembly and is pivotable between a first position, in which the nozzle is located adjacent the surface to be cleaned, and a second position, in which the nozzle is spaced away from the surface to be cleaned. A spray nozzle is provided for spraying liquid from the liquid delivery system in a first cleaning mode. The spray nozzle is mounted to one of the cleaning head, the handle, and the suction nozzle. The suction nozzle is used in a second cleaning mode of the cleaning device.

In accordance with another aspect of the present invention, a method of cleaning a surface with a device comprising a handle assembly and a cleaning head pivotally attached to the handle assembly is provided. The method includes applying a cleaning solution to the surface from a liquid delivery system at least partially mounted on the handle assembly to a spray nozzle carried by the suction nozzle. The cleaning head is directed over the surface with the handle assembly such that dirty cleaning solution from the surface is transferred to the cleaning head. Dirt and dirty cleaning solution are selectively suctioned from the surface through a suction nozzle attached to one of the cleaning head and the handle assembly.

In accordance with another aspect of the present invention, a cleaning device is provided. The device includes a suction nozzle and a dirt collection assembly for collecting dirt and in fluid communication with the suction nozzle. The dirt collection assembly includes a dirt cup configured for collecting a first portion of the dirt. A baffle is received within the dirt cup. The baffle provides a tortuous path for air and entrained dirt. The baffle defines a dirt receiving region configured for collecting a second portion of the dirt. A filter is received within the dirt cup. A source of suction is fluidly connected with the dirt collection assembly for creating a flow of working air which draws dirt from the suction nozzle into the dirt collection assembly such that a first portion of the dirt is collected in the dirt cup, and a second portion of the dirt is collected in the baffle receiving region, and a remaining portion of the dirt is removed by the filter.

The advantages of the present invention will be readily apparent to those skilled in the art, upon a reading of the following disclosure and a review of the accompanying drawings.

BRIEF DESCRIPTION OF THE DRAWINGS

The invention is described in conjunction with accompanying drawings. The drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description.

DETAILED DESCRIPTION OF THE PREFERRED EMBODIMENTS

Figure 1:
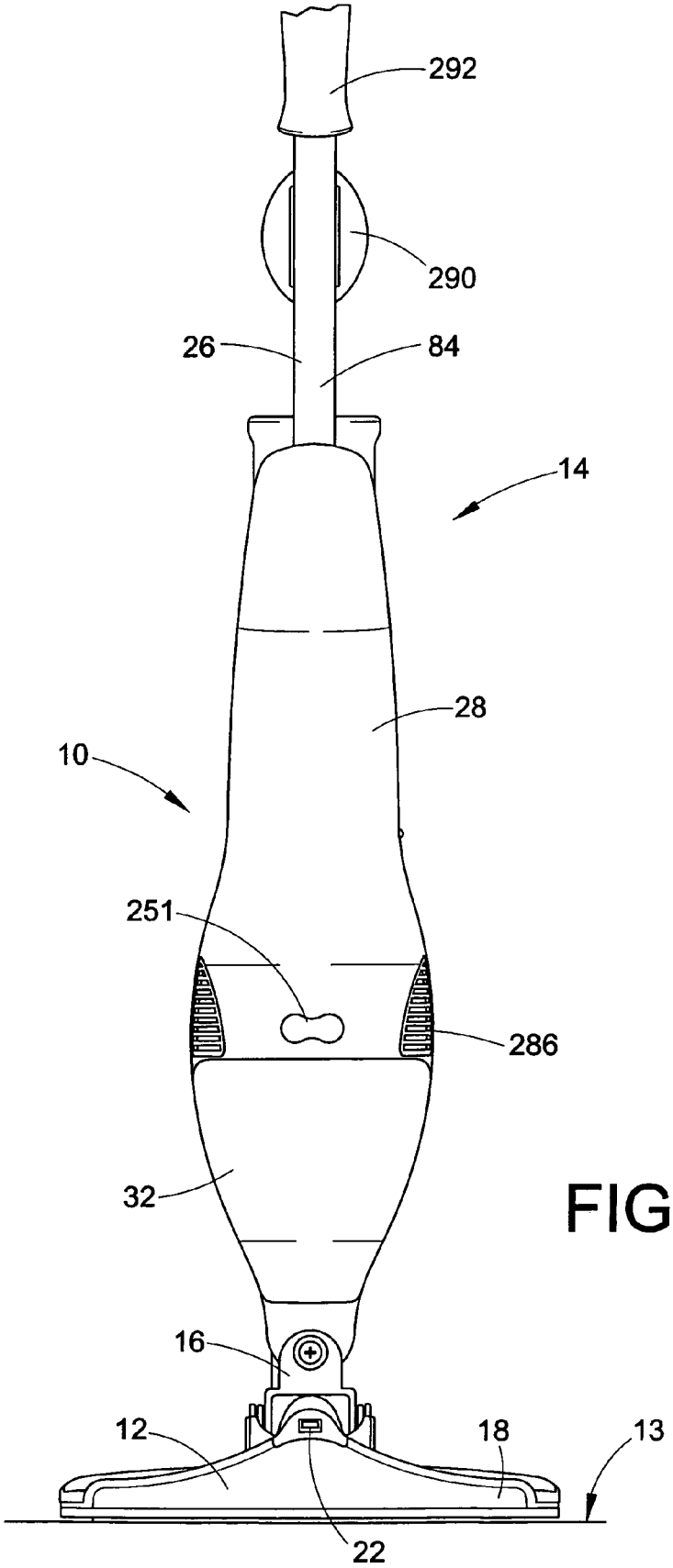
FIG. 1 is a front perspective view of a first embodiment of a floor cleaning device according to the present invention.

Referring now to the FIGURES, wherein the showings are for purposes of illustrating several preferred embodiments of the invention only and not for purposes of limiting the same, FIG. 1 illustrates a floor cleaning device 10 suited to the cleaning of vinyl, ceramic, and finished wood floors, and other hard surfaces. The floor cleaning device 10 incorporates both mopping and suction functions, allowing an operator to change rapidly from dirt suctioning to mopping.

Figure 2:
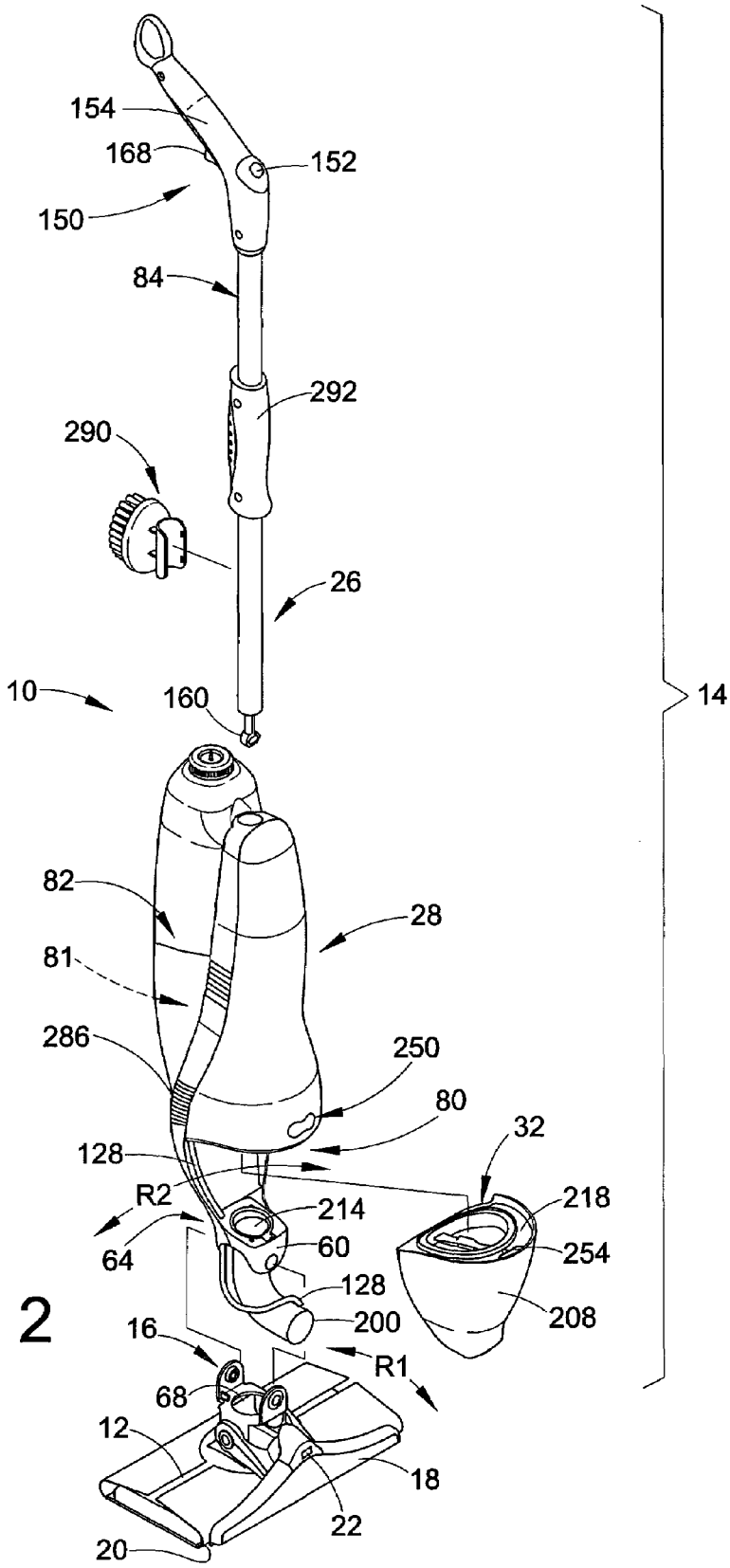
FIG. 2 is an exploded perspective view of the floor cleaning device of FIG. 1.

The cleaning device 10 includes a cleaning head 12 for contacting a floor surface 13 to be cleaned, and an elongate handle assembly 14, which is pivotally attached to the cleaning head by a universal joint 16, best shown in FIG. 2. During floor cleaning, the handle assembly 14 is positioned at an acute angle to the direction of travel of the cleaning head 12, for directing the cleaning head across the floor surface.

Figure 3:
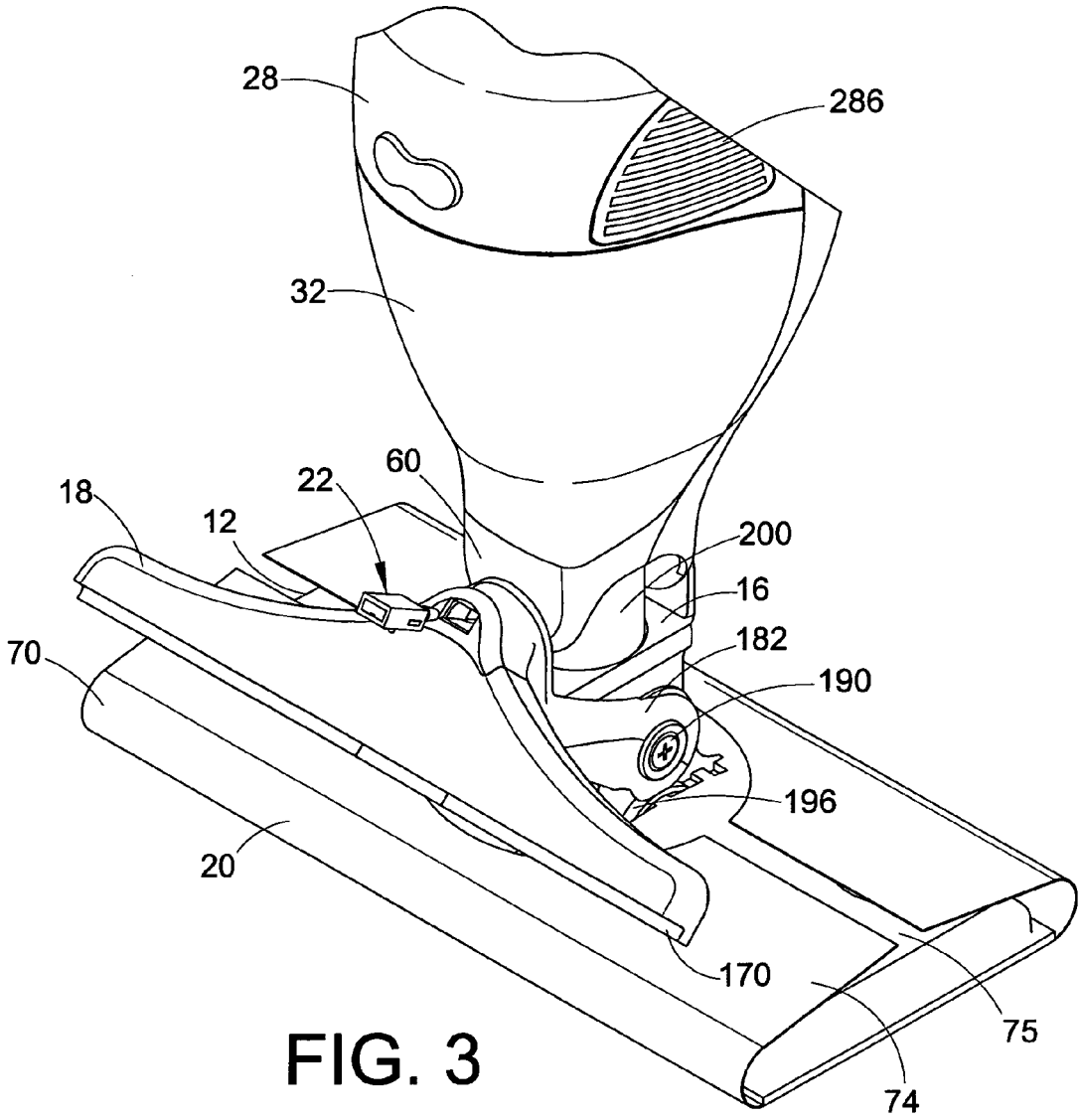
FIG. 3 is an enlarged perspective view of the lower end of the cleaning device of FIG. 1, showing the suction nozzle in a raised position, with the spray nozzle shown displaced from the suction nozzle, for clarity.

A suction nozzle 18 extends forward of a leading edge 20 of the cleaning head 12 and is movable between a floor suctioning position, illustrated in FIG. 2, and a raised position, illustrated in FIG. 3. One or more spray nozzles 22 are mounted to the cleaning device for delivery of a spray of cleaning fluid onto the floor surface adjacent the cleaning head. In the illustrated embodiment, the spray nozzle 22 is attached to an upper end of the suction nozzle 18, and thus is movable with the suction nozzle. In an alternative embodiment, the spray nozzle is attached to an upper surface of the cleaning head 12, to the universal joint 16, or elsewhere on the cleaning device for delivering a spray of a cleaning fluid to the floor surface. In yet another embodiment, the spray nozzle clips onto the cleaning head, allowing it to be removed from the device when not in use. The spray nozzle 22 can produce a fine spray which contacts the floor forward of the cleaning head 12. The spray created by the nozzle(s) 22 may be a fluidic oscillating spray, a fan angled spray, or a uniform distribution spray, as desired. In one embodiment, an oscillating spray is employed which delivers cleaning fluid across a fan-shaped area over about 52° forward of the cleaning head. One suitable spray nozzle for generating such an oscillating fan pattern is a fluidic oscillator obtainable from Bowles Fluidics Corp., 6625-T Dobbin Rd, Columbia, Md. 21045. The cleaning head 12 picks up at least a portion of the sprayed cleaning fluid, together with dirt loosened from the floor surface. In the illustrated embodiment, the spray nozzle 22 is carried by a spray tip cover 24, which is removably attached to the upper end of the suction nozzle 18, although other attachment means are also contemplated.

The cleaning fluid can be a liquid, such as water or a suitable conventional cleaning solution. Suitable cleaning liquids include those marketed by Procter and Gamble and by Clorox for use with their Swiffer™ Wet Jet and Ready-Mop™ floor cleaning devices. For example, the cleaning fluid can include a detergent in water for improving the removal of dirt from the floor. The cleaning liquid may include other additives, such as antimicrobial agents, bleaches, and the like. For cleaning wood floors, the cleaning fluid can be formulated to minimize damage to the floor and may include a wax or other wood floor coating ingredients.

Figure 4:
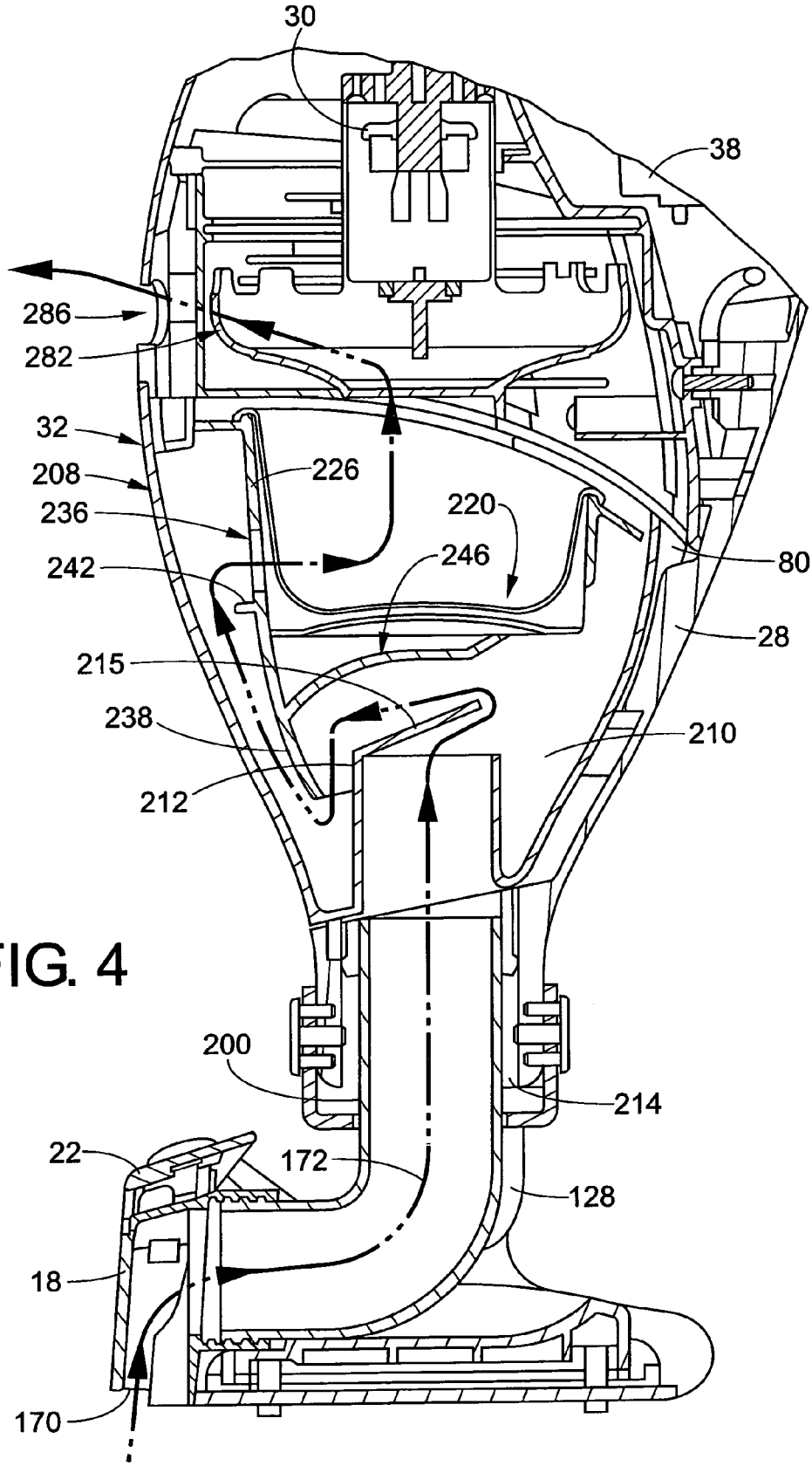
FIG. 4 is a side sectional view of the cleaning device of FIG. 1.
Figure 7:
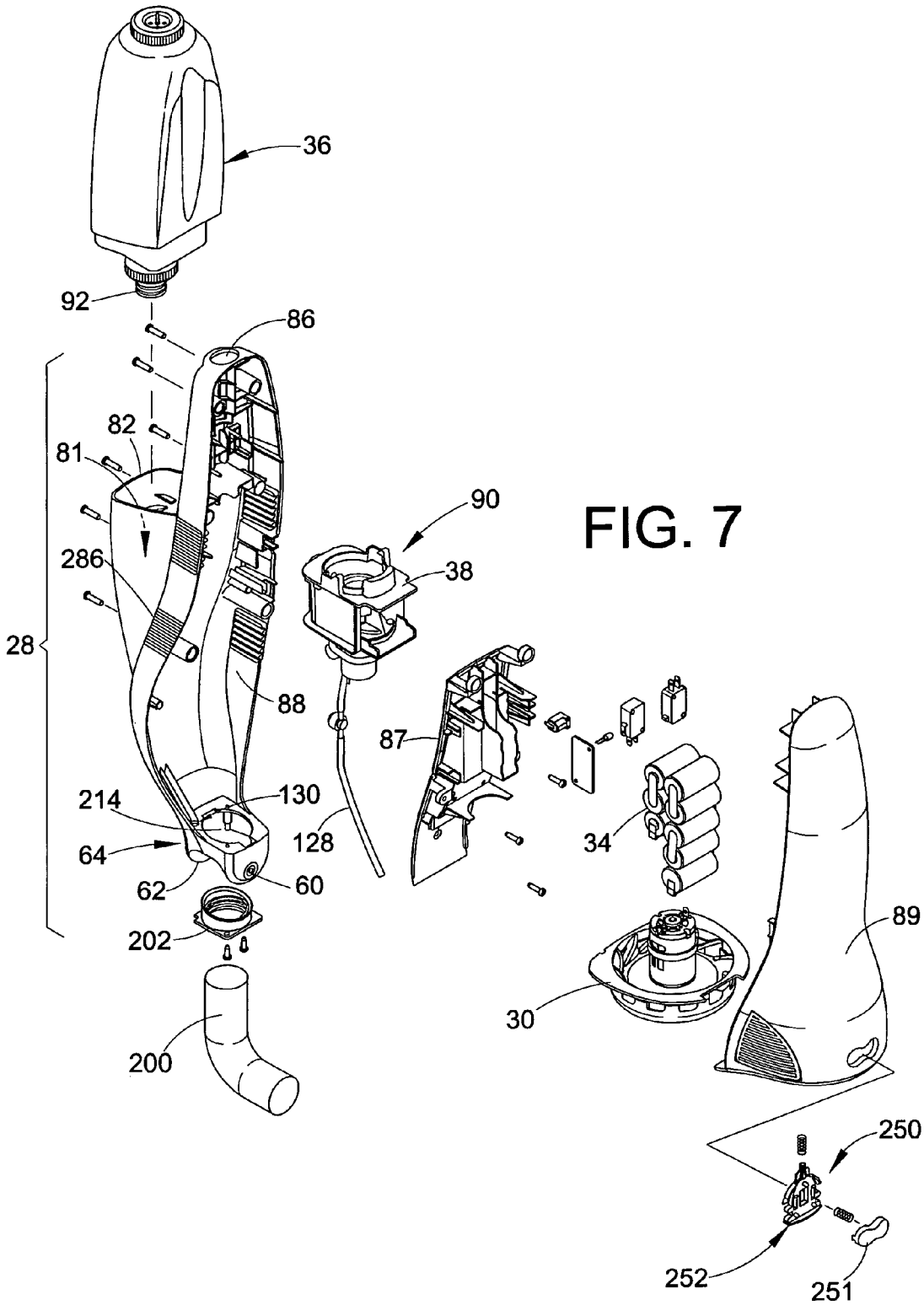
FIG. 7 is an enlarged exploded perspective view of part of a handle assembly of the floor cleaning device of FIG. 1.

With reference to FIG. 1, the handle assembly 14 includes an upper handle portion 26 and a housing 28, which is mounted to a lower end of the upper handle portion. As shown in FIGS. 4 and 7, the housing 28 accommodates a fan and motor assembly 30, a dirt collection assembly 32, a power source 34, such as one or more replaceable/rechargeable batteries, a cleaning fluid supply reservoir 36, and a cleaning fluid delivery pump 38, each of which will be described in greater detail below.

Figure 5:
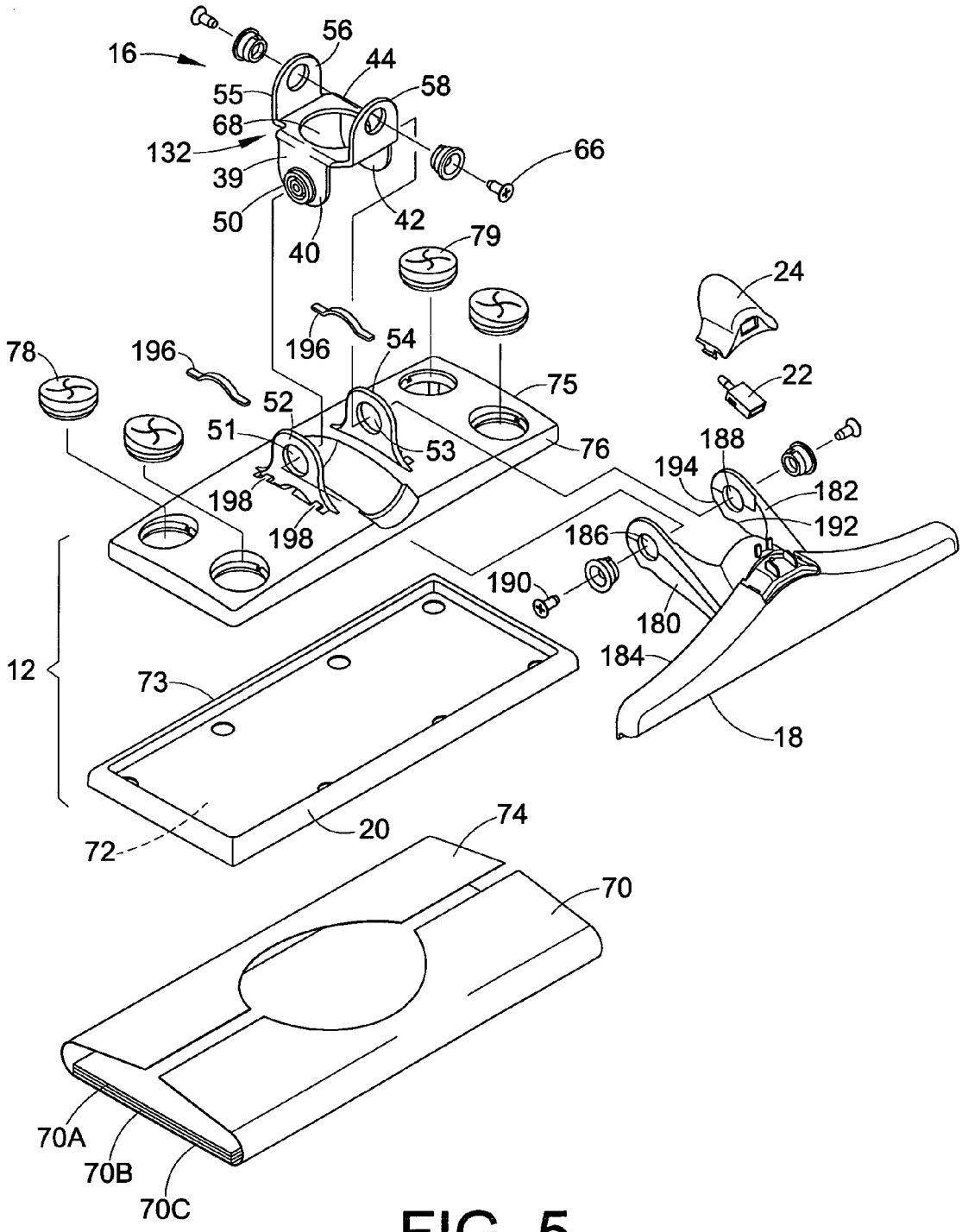
FIG. 5 is an enlarged exploded perspective view of a lower portion of the floor cleaning device of FIG. 1.

With reference once more to FIG. 2, the universal joint 16 permits rotation of the cleaning head 12 relative to the handle assembly 14 about two rotational axes, as indicated by arrows $R_1$ and $R_2$. The rotational axes are angularly spaced, preferably by about 90°. As shown in FIG. 5, the universal joint 16 includes a first rotational joint or clevis 39 comprising first and second spaced and generally parallel arms 40, 42, which extend downward from opposite sides of a central portion 44. The arms 40, 42 receive disk-shaped pivot pins 50 which are also received in respective aligned apertures 51, 53 positioned in spaced flanges 52, 54 extending upward from the cleaning head 12. In other words, the clevis 39 is rotatably mounted on the cleaning head 12. The handle assembly 14 is thus able to pivot forward or rearward, relative to the cleaning head 12, as shown by arrow $R_1$ in FIG. 2.

The universal joint 16 includes a second clevis or rotational joint 55, oriented perpendicular to the first clevis 39. The second clevis 55 includes first and second spaced and generally parallel arms 56, 58, similar to arms 40, 42, which extend upward from an opposite face of the central portion 44 to the arms 40, 42. The arms 56, 58 are pivotally connected to flanges 60 (see FIG. 2) at a lower end 64 of the housing 28 by pivot pins 66. This allows the handle assembly 14 to pivot relative to the universal joint 16 as shown by arrow $R_2$ (FIG. 2). The second rotational joint 55 thus has a rotational axis perpendicular to the axis of the first rotational joint 39. It will be appreciated that other conventional methods of attachment of the handle assembly 14 to the cleaning head 12 are also contemplated. The central portion 44 includes a large aperture 68 for accommodating a hose, as will be discussed below.

For floor mopping operations, the cleaning device 10 can be maneuvered, for example, forwards and backwards or side to side by moving the handle assembly 14 as required. As a result, the movement of the handle will be translated, via the universal joint 16, to the cleaning head 12.

With reference once more to FIG. 5, the cleaning device 10 accepts a cleaning fabric pad 70, which is removably attached to the cleaning head 12 such that it covers a substantially flat lower surface 72 of the cleaning head. The lower surface 72 can be defined by a rectangular plastic or foam plate 73. The cleaning pad 70 may be formed from multiple layers or be a single sheet of material. In one embodiment, the pad 70 has a multilayer construction including an upper layer 70A, formed form a water impermeable material, such as plastic. An intermediate layer 70B is formed from a highly absorbent material, such as a synthetic plastic microporous foam. A lower layer 70C includes extension portions 74, which extend beyond the perimeter of the upper layers such that the layer 70C can be wrapped around the cleaning head 12 and releasably attached to an upper surface 75, as described below.

The lower layer 70C is preferably formed from a fabric which is sufficiently durable such that the layer will retain its integrity during the cleaning process. It is permeable to water and other liquids, which pass through the lower layer into the absorbent layer 70B, where they are trapped. The pad is preferably disposable, although reusable pads, which can be cleaned by washing, are also contemplated. It is also contemplated that different types of pad may be used depending on the type of cleaning to be performed. For example, if the user plans to do only dry cleaning at a particular time, a pad 70 comprising an electrostatic layer suited to picking up dry dirt may be employed. Such pads are particularly suitable for removal and entrapment of dust, lint, hair, grass, and the like. Pads particularly suited to polishing and/or buffing wood floors may be selected for wood floor cleaning operations.

With continued reference to FIG. 5, the upper surface 75 the cleaning head 12 may be defined by a support plate 76, formed from metal or plastic, which is attached at a lower surface thereof to the plate 73. Gripping members or clips 78 are provided on the upper surface 75, or elsewhere on the cleaning head, for releasable gripping the pad 70. Specifically, the gripping members each include a slit or slits 79 in a deformable material which allow the extension portions 74 of the pad to be pushed into a hole created by temporary deformation of the area around the slit when the gripping member is pressed. The gripping members may be removably attached to the support plate 76 (for example, using corresponding threaded regions, as shown) to allow the gripping members 78 to be replaced by gripping members of the same or of a different type.

Figure 6:
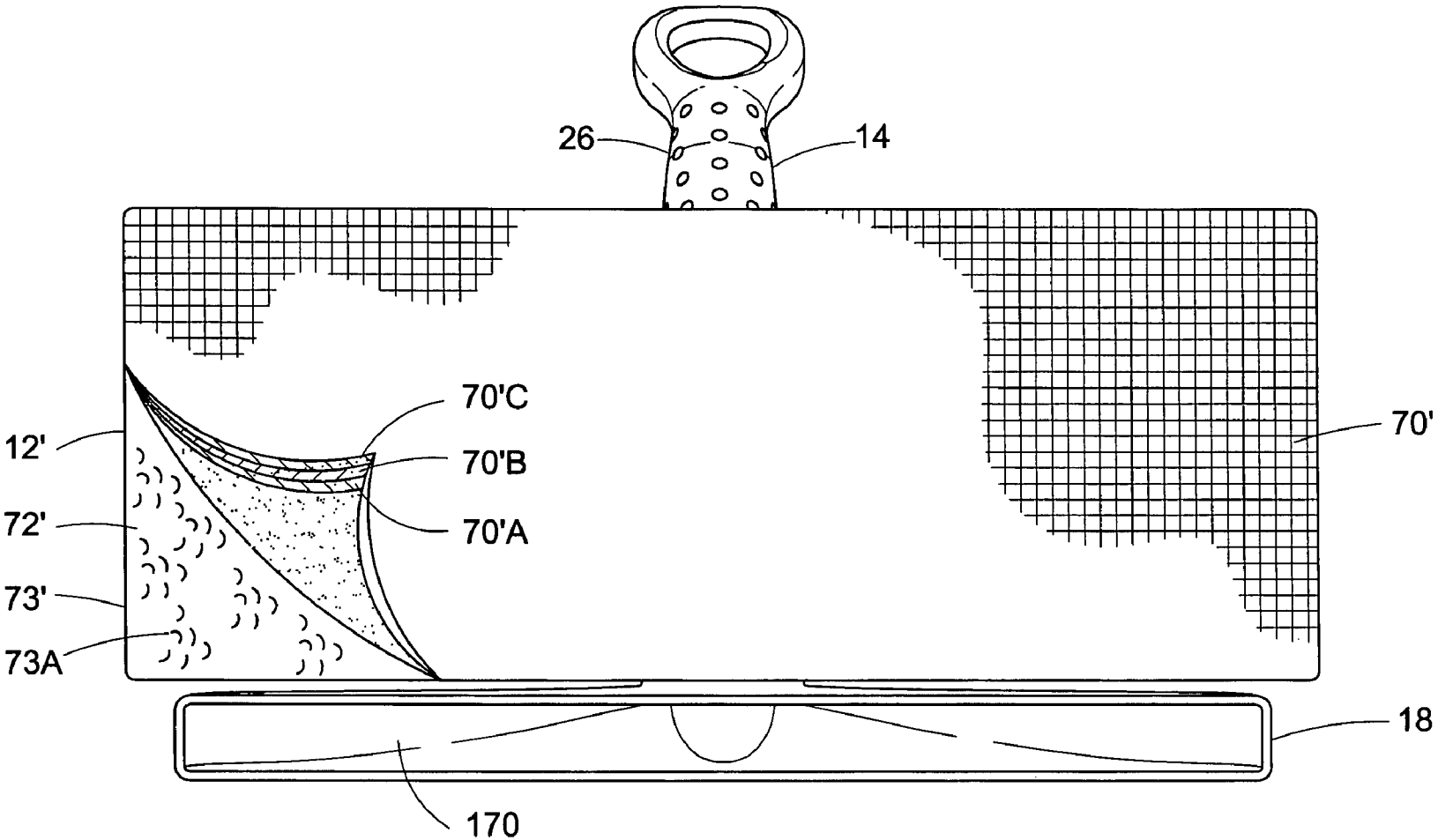
FIG. 6 is a bottom plan view of an alternative embodiment of a floor cleaning pad attached to a lower surface of a cleaning head of a floor cleaning device, with one corner of the pad peeled back to reveal its multi-layer construction.

FIG. 6 shows an alternative embodiment of a pad 70', where similar elements are identified with a primed (') suffix and new elements are identified by new numerals. The pad 70' has a multilayer construction including an upper layer 70'A, which is capable of attaching to a strip of conventional hook material 73A secured to a plate 73'. Also provided are an intermediate layer 70'B of an absorbent material, and a lower layer 70'C for contacting a surface meant to be cleaned during the cleaning operation. The pad upper layer 70'A, which includes a loop material, and the hook material 73A cooperate to form a hook and loop fastening system of the well known Velcro™ type. The hook material 73A can be adhesively attached or molded onto the surface 72', although other attachment methods are contemplated. Thus, the bottom surface 72' of the cleaning head 12 engages at least a portion of the cleaning pad 70' during use.

With reference once more to FIG. 2, the housing 28 includes a front socket 80, which receives the dirt cup assembly 32. The lower end 64 of the housing 28 is pivotally connected with the universal joint, below the socket, as described above. The housing 28 also defines a rear socket 81, best shown in FIG. 7, with an upper opening 82 for receiving the cleaning fluid reservoir 36, which may be in the form of a replaceable bottle. The upper handle portion 26 (FIG. 2) includes a cylindrical sleeve 84, the lower end of which is received through an opening 86 in the housing. The end of the sleeve 84 is bolted or otherwise fixedly attached to the housing 28. The housing 28 can be formed from two, three, or more housing portions 87, 88 and 89, which are screwed, adhesively attached, snap fitted or otherwise connected together to form the housing.

Figure 8:
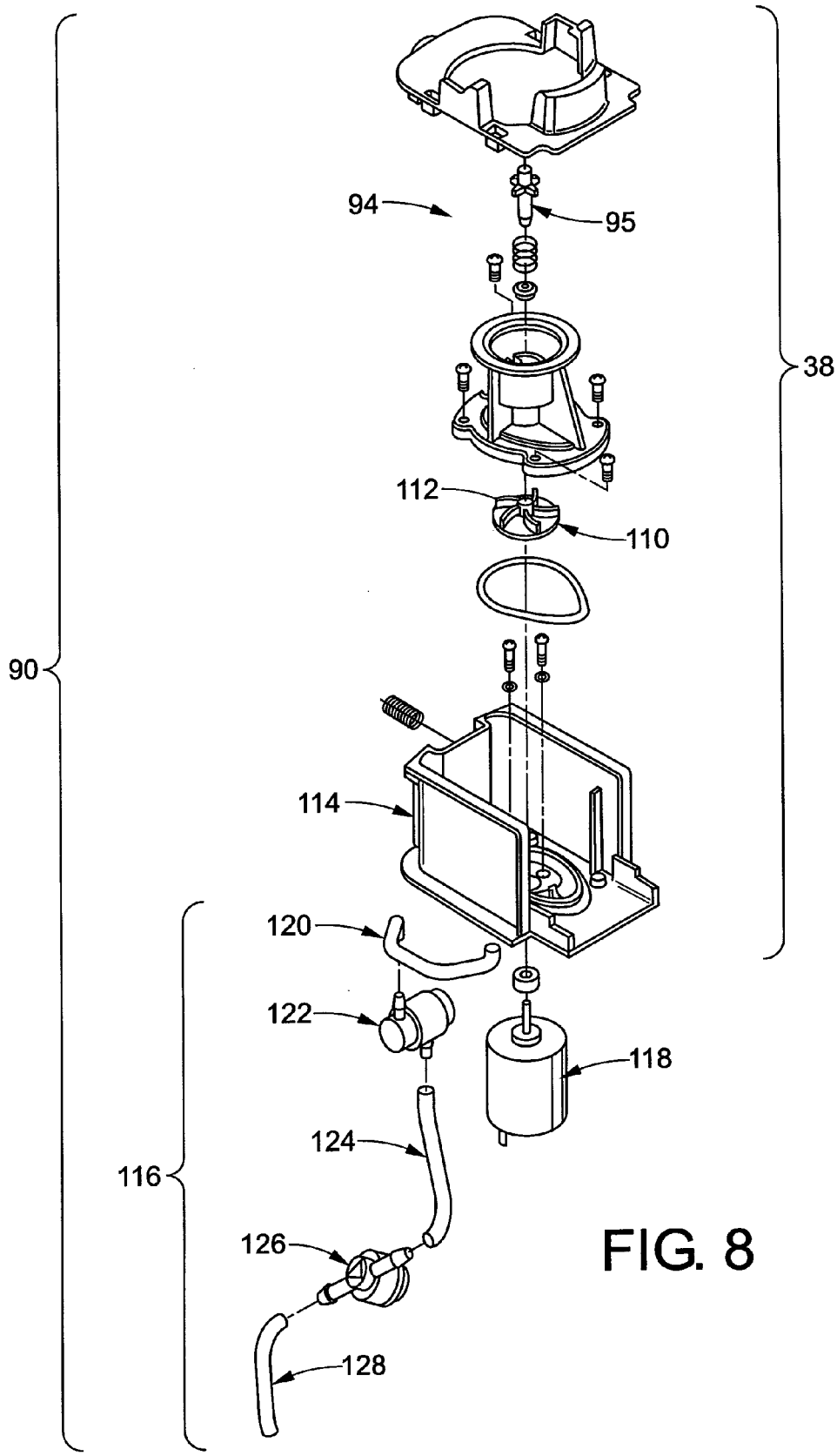
FIG. 8 is an exploded perspective view of a fluid delivery system for the cleaning device of FIG. 1.

With continued reference to FIG. 7, a liquid delivery system 90, which includes the pump 38, delivers the cleaning liquid from the reservoir 36 to the spray nozzle 22. As the reservoir 36 is inserted into the housing, the reservoir is automatically connected with the liquid delivery system 90. Specifically, the reservoir 36 includes a first closure or cap 92 (FIG. 9), which is brought into engagement with an opening assembly 94 of the pump, best shown in FIG. 8. The opening assembly 94 may include a spring biased valve opening member 95, which opens a valve 96 mounted within the cap 92 of the reservoir. The valve 96 may also be biased by a spring 97 into a closed position, unless acted on by the opening assembly 94 allowing fluid to flow from a lower opening or outlet 98 in a reservoir bottle 99 to the pump 38.

Figure 9:
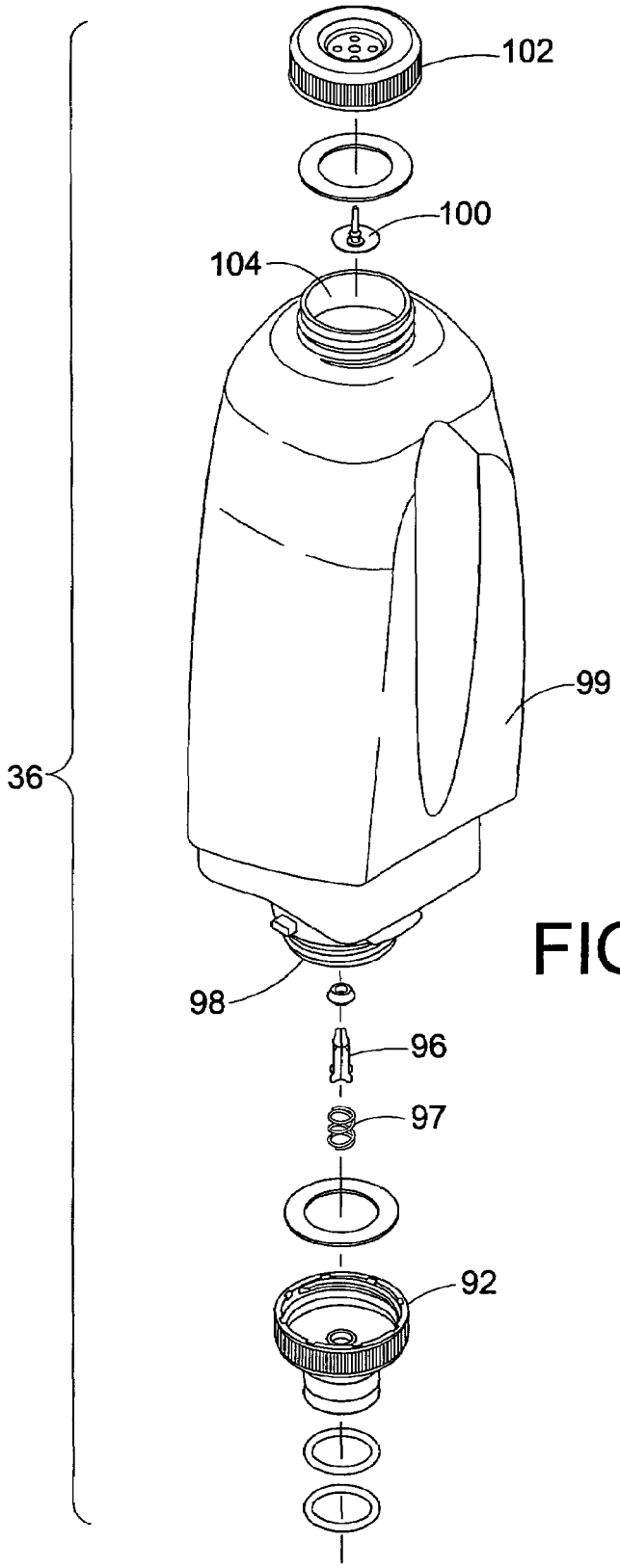
FIG. 9 is exploded perspective view of a cleaning fluid reservoir of the floor cleaning device of FIG. 1.

With reference now to FIG. 9, a vent valve 100 allows air to enter the bottle to replace the volume of fluid dispensed. That is, as cleaning fluid is pumped from the reservoir 36, ambient air is admitted through the vent valve 100 to replace the fluid so that the reservoir does not collapse or generate a vacuum within the container 36. The reservoir vent valve 100 may be associated with a second cap or closure 102, which closes an upper opening or inlet 104 in the bottle 99. The second opening 104 is positioned above the fluid level, e.g., at an opposite end of the bottle from the lower opening 98. The bottle 99 may be about a 25 cm tall by about 6 cm diameter bottle blow molded from a high density polyethylene or other suitable plastic.

Alternatively, the vent valve may be located below the fluid level. In one embodiment, the vent valve is associated with the cap 92 and is positioned adjacent to the valve 96.

Another suitable connection mechanism for the reservoir is described in U.S. Pat. No. 6,321,941, which is incorporated herein in its entirety by reference. In such a system, a closure or cap of the bottle is brought into engagement with a bottle piercing assembly, which is movably mounted in the socket 81. The bottle piercing assembly includes two piercing needles which puncture a portion of the cap, such as an elastomeric gasket. One of the needles is connected with a vent valve, which allows air to enter the reservoir 36 as the cleaning liquid is dispensed. The other needle is fluidly connected with the pump 38. The gasket may be injection molded of silicone rubber.

With reference once more to FIG. 8, the pump 38 can be an impeller pump, a gear pump, peristaltic pump, or any other known liquid pump. In the illustrated embodiment, the pump is a vaned impeller pump. The pump includes an impeller 110, with a plurality of radially spaced vanes 112, five in the illustrated embodiment. The vanes direct the fluid radially outward, towards the walls of a pump housing 114. A fluid supply pathway 116 connects the pump housing with the spay nozzle 22. A drive motor 118 for the pump 38 is powered by the power source 34 (FIG. 7), such as batteries. For example, a low-voltage DC motor 118 is readily powered by the batteries 34. The cleaning device 10 may be configured to employ a wall mounted charger (not shown) for recharging the batteries without the need for removing them from the housing. Alternatively, a socket (not shown) in the housing is adapted to receive a drop in battery pack. One such battery pack is sold by Black and Decker, Inc. of Towson, Md., under the mark Versapack™. Although batteries 34 represent one means for powering and operating the pump 38, other alternatives may be used. For example, an electric power cord (not shown) can be selectively connected to a source of AC power for supplying electrical power to the pump 38, fan motor 30, and any other electrically operated components of the device, or, the pump may be manually operated.

The fluid flows through an opening in the pump housing 114 and travels via the fluid supply path 116 to the spray nozzle 22. The fluid supply path includes a first fluid supply conduit 120, such as a flexible tube, which connects the pump housing with the inlet of a solution filter 122. The solution filter filters dirt and other small particles from the cleaning liquid which may clog the spray nozzle. If the cleaning fluid is free of particles, the filter may not be needed.

The outlet of the solution filter 122 is connected by a second conduit 124 to the inlet of check valve 126. The check valve 126 may be a solenoid valve, spring loaded ball valve, or other type of check valve commonly known in the art. The check valve 126 limits a dribbling of fluid from the spray nozzles 22 particularly when the suction nozzle 18 is in operation. The check valve 126 may also generate a cracking pressure so that fluid entering into the spray nozzle(s) 22 has sufficient energy to drive the fluid through the spray nozzle(s) 22 and break the fluid up into fine droplets.

In an alternative embodiment embodiment, the check valve 126 also serves as a shut off valve which remains closed until it is desired to dispense fluid from the spray nozzle. Or, a separate shutoff valve may be provided elsewhere in the fluid pathway 116. In such an embodiment, the pump can be left running continuously throughout a floor cleaning operation, running continuously in both mopping and suction modes. For this embodiment, the valve 126 would be used to close off the flow during the suction mode. Alternatively or additionally, the pump 38 can be switched off during the suction mode.

Another suitable pump for use as the solution pump is a gear pump as is described in U.S. Pat. No. 6,328,543, which is incorporated herein in its entirety by reference. Because of the continuous static head from the reservoir 36, a check valve analogous to the check valve 126 can have a cracking pressure greater than the static head, so that no leakage occurs through an inactive pump. The cracking pressure could be higher than the static head to the extent that fluid passing through the check valve 126 when the pump operates has sufficient pressure to cause the spray nozzle 22 to produce a fine spray.

Vaned impeller pumps have advantages in that the dimensions are less critical and tolerances for the vanes are larger than is the case with gears in a gear pump. If a gear pump is used, the reservoir 36 can be located directly above the gear pump so that a static head is always present to prime the pump, and no suction is required. This helps to minimize precision and power, and therefore size and cost of the pump. With a vaned impeller pump, the reservoir need not be located above the pump. Although it may be convenient to do so.

A third conduit 128 is connected with an outlet of the check valve 126 and passes out of the housing 28. The conduit 128 connects at its distal end with the nozzle 22.

As can be seen in FIGS. 2 and 7, the conduit 128 may be routed through an opening 130 in the lower end of the housing 28 so that the supply conduit does not need to pass through the u-joint and potentially become entangled in the suction hose. A slot 132 (FIG. 5), formed in an external surface of the central portion 44 of the u-joint, receives the conduit 128 therethrough. Alternatively, the hose 128 may be clipped to an exterior surface of the u-joint by a suitable clip.

The fluid delivery system 90 thus described includes conduits 120, 124, 128, pump 38, check valve 126, filter 122, and optionally, a separate shut off valve. It will be readily appreciated, however, that alternative fluid delivery systems, such as those employing gravity feed, pressure on the bottle by squeezing with the user's hand, or other means of supplying the fluid to the nozzle 22, are also contemplated.

Figure 10:
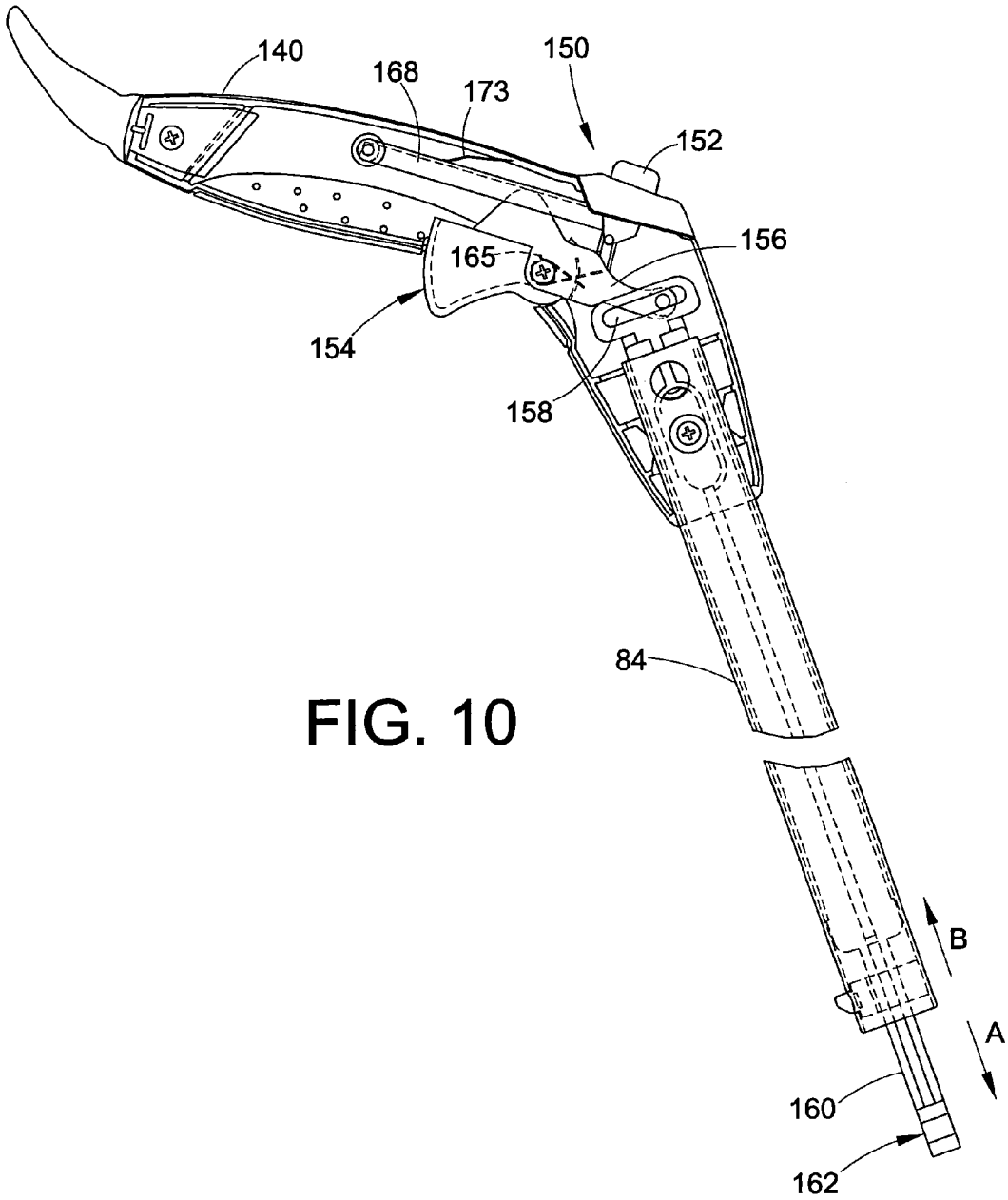
FIG. 10 is an enlarged side sectional view of an upper portion of a handle assembly of the floor cleaning device of FIG. 1.
Figure 11:
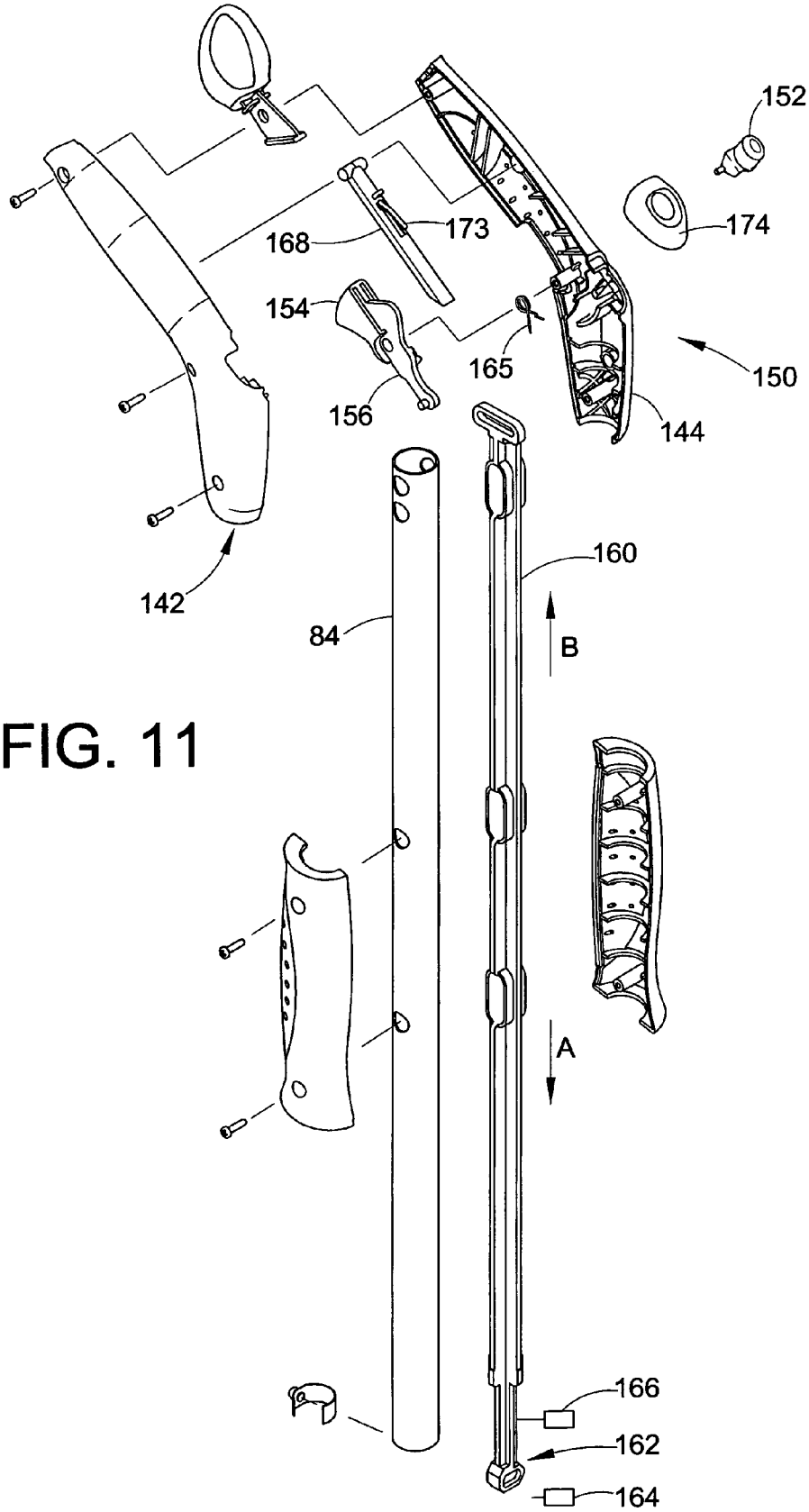
FIG. 11 is an exploded perspective view of the upper portion of a handle assembly of FIG. 10.

With reference to FIG. 10, the upper handle portion 26 includes a hand grip 140, which may be assembled from left and right hand grip portions 142, 144, as illustrated in FIG. 11. The left and right hand grip portions are screwed, bolted or otherwise attached to each other to enclose an upper end of the sleeve 84. A manually operable actuation system 150, best is associated with the hand grip and operates the fan and motor assembly 30 and the pump 38 and/or valve 126. The actuation system 150 includes a thumb or finger-operated thumb switch 152 and a trigger 154, which can both be mounted to the hand grip 140. In the illustrated embodiment, the hand grip is formed from left and right hand grip portions 142, 144.

The trigger 154 is pivotally mounted to the handle grip and has an extension portion 156 which extends into the hand grip. The end of the extension portion is received within a slot 158 in an upper end of an actuation rod or linking rod 160. The linking rod 160 is carried within the hollow sleeve 84. When the trigger is depressed, the linking rod is pushed in a generally downward direction, illustrated by arrow A, away from the hand grip 140. The actuation rod 160 carries an actuating member 162, such as a protrusion or ring, which actuates a first microswitch 164 (FIG. 11). The actuation of the first microswitch 164 energizes the fluid supply pump 38 (and/or actuates the shut off valve 126 to move to the open position), whereby the supply of liquid from the reservoir 36 to the spray nozzle 22 is initiated. In this mode, the pump 38 withdraws cleaning solution from the reservoir 36 and directs it to the spray nozzle 22, via the fluid supply pathway 116. A user maneuvers the cleaning head 12 over the floor, using the handle assembly 14. The sprayed cleaning fluid and dirt from the floor are collected on the replaceable pad 70 as the cleaning head passes across the floor.

When pressure on the trigger is released, a torsion spring 165 biases the trigger to the off position, and the fluid delivery is interrupted.

The switch 152 is operable to convert the device 10 from the mopping mode to the vacuum suction mode. Specifically, when the thumb switch 152 is depressed, the actuation rod or linking rod 160 is pushed in a generally upward direction, illustrated by arrow B towards the hand grip 140. The actuating member 162 actuates a second microswitch 166 (FIG. 11) only when the thumb switch 152 is depressed. In particular, the thumb switch 152 engages a trigger arm 168 which is pivotally mounted to the hand grip. Pressure on the thumb switch rotates the trigger arm, causing the trigger extension 156 to pull the actuation rod 160 in the direction of arrow B.

The second microswitch 166 can be mounted, either in the sleeve 84 or in the housing 28, in spaced relation to the first microswitch 164. Actuation of the switch 166 causes the fan motor assembly 30 too operate, creating a suction force on the suction nozzle 18. Additionally, it will be appreciated that when the actuation rod 160 is retracted, by pulling upward, the protrusion 162 is released from engagement with the first microswitch 164, switching off the pump 38 (and/or closing the shut off valve 134) and thereby closing off and/or switching off fluid flow to the spray nozzle 22.

The floor cleaning device 10 is thus operable in a suction mode. The user maneuvers the cleaning head 12 over the floor surface using the handle assembly 14. The suction fan motor assembly 30 creates a flow of working air at a suction inlet 170 (FIG. 6) of the suction nozzle 18. Dirt and dust from the floor enter the suction nozzle inlet 170 and are carried along a working air flowpath 172 (FIG. 4), defined in part by the suction nozzle 18, and into the dirt collection assembly 32, along with the working air. If both suction and mopping operations are to be carried out, the suction operation can be performed first and then the device 10 can be converted to the spray/mopping mode by changing the switch position.

The trigger arm 168 includes a flat spring 173, which biases the thumb switch 152 to the off position when the pressure on the switch is removed. Optionally, a thumb lock button 174 is actuated (e.g., slid forwardly) to lock the switch 152 in a selected position, such as the depressed position. This allows the user to lock the switch in the suction mode. The switch 152 can be released by sliding the lock button rearwardly.

Other embodiments are also contemplated, such as a single switch which operates to either actuate fluid delivery or to actuate suction. For example, a slide switch may have first and second positions, $S_1$, $S_2$, for actuating the microswitches 164 and 166, respectively, and optionally an intermediate, OFF position $S_3$, in which neither of the microswitches is actuated.

It will be appreciated that the positions of the two microswitches 164, 166 shown in FIG. 11 may be reversed, such that the fan motor assembly 30 is operated by pulling on the trigger 154 and the liquid spray is operated by pushing on the switch 152. Additionally, while the switch 152 and trigger 154 are most conveniently positioned on or adjacent the hand grip 140, it is also contemplated that one or other of the switch 152 and trigger 154 may be positioned elsewhere on the device 10. For example, a foot operated rocker switch may be provided on the cleaning head, or the switch may be located on the housing.

As noted above, the suction nozzle 18 is movable between a first position, in which the inlet is adjacent the floor surface, and a second position, in which the nozzle inlet is spaced from the floor surface. More particularly, and with reference again to FIG. 5, the suction nozzle 18 is pivotably mounted on the support plate 76 by a pair of spaced apart arms 180, 182, which extend from a rearward end 184 of the suction nozzle. The arms 180, 182 each have a hole 186, 188, respectively, through which pivot pins 190 extend to rotatably secure the suction nozzle to the corresponding flanges 52, 54 extending from the upper surface 75 of the support plate 76.

Each of the suction nozzle arms 180, 182 has a forward and a rearward concave surface 192, 194 which engage or ride upon a respective detent 196 in the form of a flat spring. Ends of the flat spring 196 snap fit into corresponding slots 198 defined in the support plate upper surface 75, adjacent the respective support plate flange 52, 54. The suction nozzle 18 is manually pivoted or rotated from an operating (suction) position, in which the nozzle is adjacent to the floor surface, to a non-operating (retracted/raised) position. In the suction position, illustrated in FIG. 2, the forward surface 192 engages the flat spring 196. In the retracted position, the rearward surface 194 engages the flat spring. The suction nozzle 18 is able to move from one position to the other, under slight manual pressure, since the surfaces 192, 194 ride along the detent 196 until the suction nozzle is locked into one of the two positions.

In the suction position, the suction nozzle 18 is aligned adjacent to and generally parallel with the floor surface to be cleaned, with the suction inlet 170 pointing towards the floor. Air entrained dirt is drawn from the suction nozzle 18 to the dirt collection assembly 32, via a flexible hose 200, which passes through the opening 68 (FIG. 2). The flexible hose 200 is connected to the lower end of the housing 28 by a collar 202. In the retracted position, the inlet is spaced away from the floor, allowing easy removal of the cleaning pad 70.

Alternatively, the suction nozzle 18 could be spring biased to the retracted (raised) position. In such an embodiment, a latch (not shown) or other suitable restraining member would restrain the suction nozzle 18 against upward movement when the nozzle is in the suction position. The latch would be movable between an engaged position, in which the latch engages the suction nozzle 18 and a disengaged position, in which the suction nozzle is free to move upwardly, under the bias of the torsion spring. The latch can be normally restrained in the engaged position by a foot operated release member (not shown), which includes a foot operated switch, positioned on the cleaning head 12 or in other convenient location. To reengage the suction nozzle 18 with the latch, the user pushes the suction nozzle downward with either the foot or hand and reengages the latch. Such a latch mechanism is shown for example in application Ser. No. 10/340,691, which is incorporated herein by reference.

In another alternate embodiment, a lower end of the actuation rod 160 is operatively connected with the suction nozzle 18, such that the suction nozzle 18 is moved from the floor suctioning position (FIG. 2) to the retracted position (FIG. 3) when the switch 152 is depressed.

Figure 13:
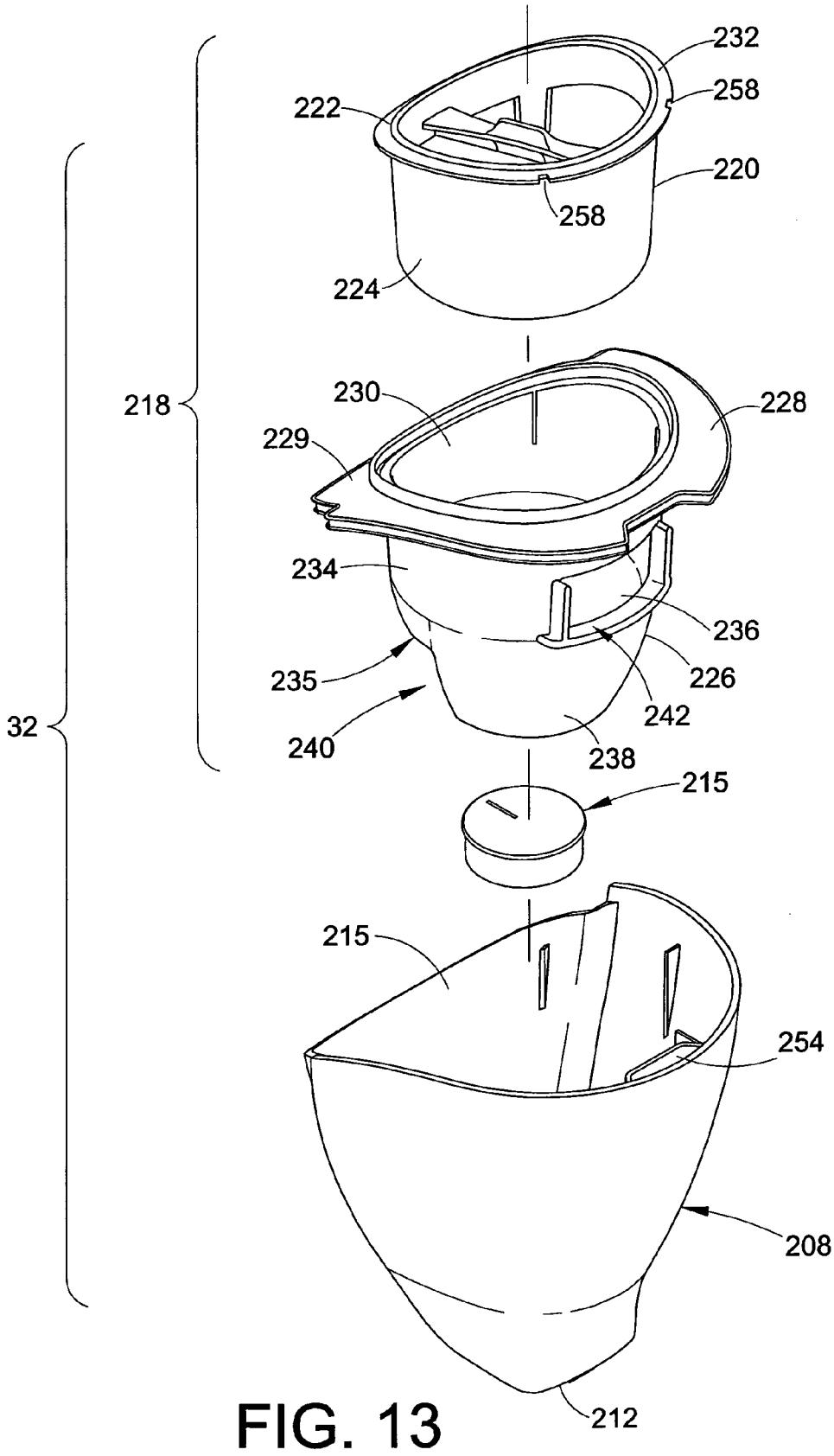
FIG. 13 is a reduced front exploded perspective view of the dirt cup assembly of FIG. 12.

With reference now to FIG. 13, the dirt collection assembly 32 includes a dirt collection receptacle 208, such as a removable, generally transparent dirt cup, fabricated from a thermoplastic material, or other suitable material. The dirt cup defines a dirt collection chamber 210. As best shown in FIG. 4, when the dirt cup 208 is positioned within the socket 80 in the housing 28, the suction nozzle 18 is fluidly connected with an inlet 212 of the dirt cup 208 by the flexible suction hose 200. The air from the suction hose 200 passes through the collar 202 mounted in the aperture 68 in the universal joint 16 and enters the housing 28 through a suitably positioned lower opening 214 located between the two flanges 60, 62 (FIG. 2).

A flap valve or dust cover 215 (FIG. 4) positioned at the dirt cup inlet 212 is normally in a closed position. When the fan motor operates, the suction force opens the flap valve 215, allowing dirt and air to be drawn into the dirt cup 208. The flap valve 215 may be formed from rubber or other suitable flexible material. When the fan motor is switched off, the flap valve falls back to its closed position, sealing off the suction nozzle 18 from the dirt cup 208 and preventing collected dirt from falling out of the device through the suction nozzle.

Figure 14:
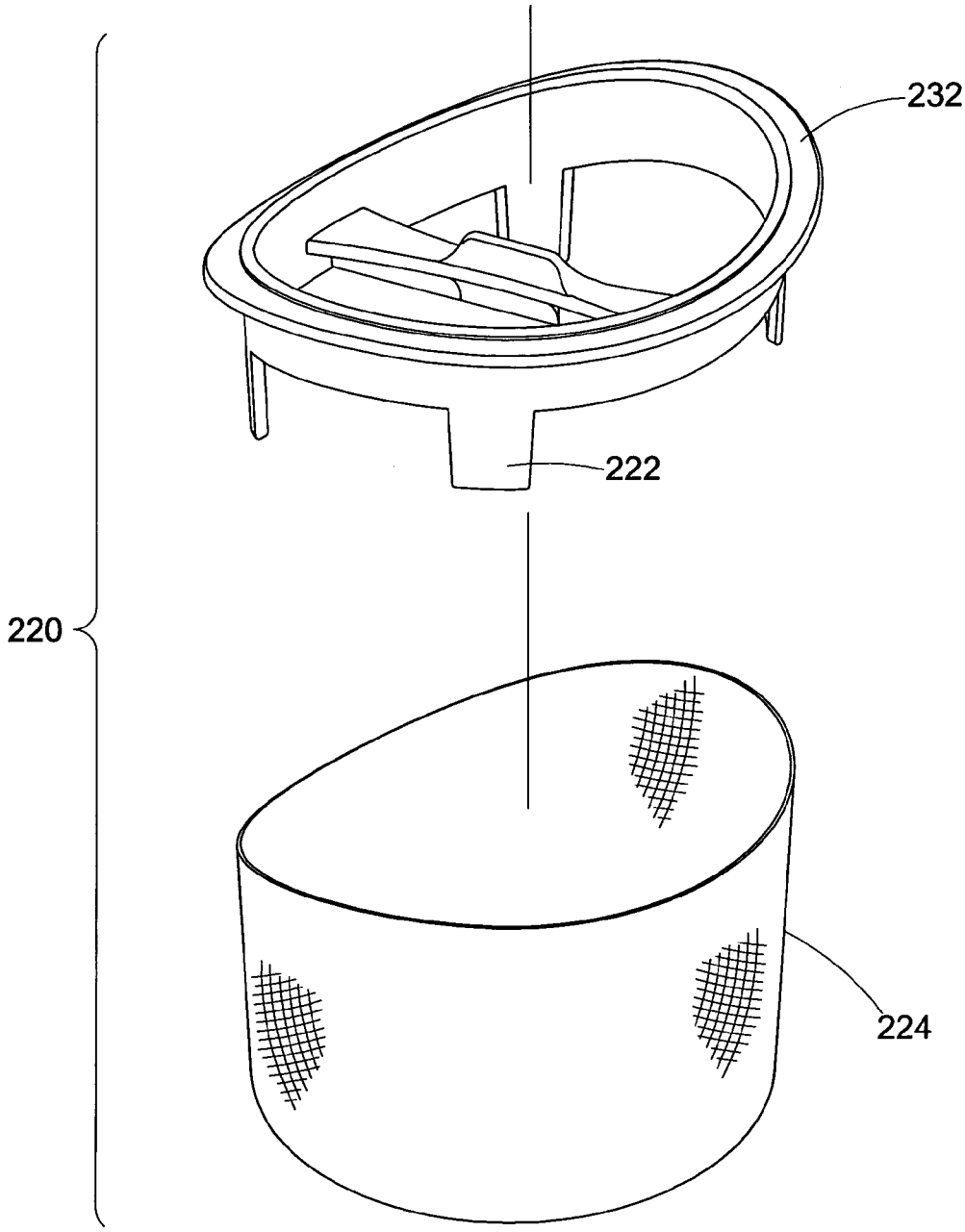
FIG. 14 is an enlarged exploded perspective view of a filter and frame of the dirt cup assembly of FIG. 13.

As shown in FIG. 13, an open end 216 of the dirt cup 208 selectively accommodates a removable filter assembly 218, which directs the airflow and filters dirt and debris from the working air before it leaves the dirt cup. As best shown in FIG. 14, the filter assembly 218 can include a filter member 220 to retain smaller particles within the dirt cup 208. The filter member 220 includes a filter support or cage 222, and a flexible filter 224 supported thereon. The filter member is removable from a baffle 226, mounted in the dirt cup 208, for cleaning. The dirt cup 208 is removed from the socket 80 in the housing and emptied of collected dirt at intervals. This entails removing the filter assembly 218 from the dirt cup and tipping out collected dirt. The filter assembly 218 may also be cleaned at this time, or less frequently, for example, by rinsing the filter member 220 in water or a detergent solution.

The filter assembly also includes a baffle 226, which is positioned within the dirt cup such that a flange 228 at an open end thereof seals around the opening in the dirt cup. The flange may be fitted with an overmolded seal 229 formed from rubber or other compressible material, to aid in creation of a seal between the flange and the dirt cup. The baffle 226 defines an upper opening 230 shaped to receive the filter member therethrough, whereby the filter member is seated in the baffle. A flange 232 at an upper end of the filter cage 222 forms a seal between the filter member and the baffle 226.

Figure 12:
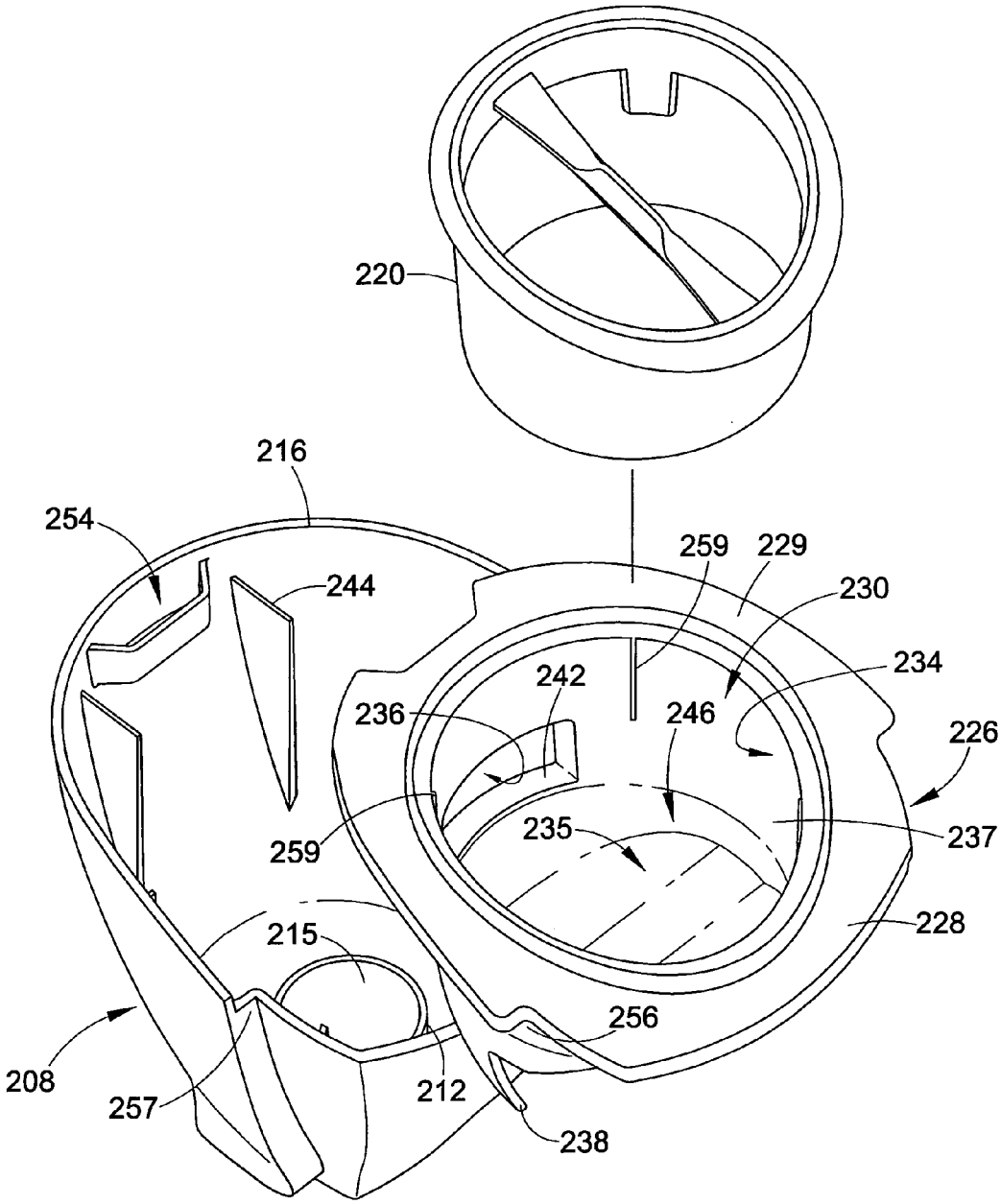
FIG. 12 is an enlarged exploded rear perspective view of a dirt cup assembly of the floor cleaning device of FIG. 1

As best shown in FIG. 12, the baffle 226 includes an annular, generally vertical wall 234 which is closed at a lower end with a base 235. The annular wall defines a side opening 236 which serves as an air inlet through which air enters a chamber 237 within the baffle. Air enters the dirt cup 208 via the movable flap valve 215 at the end of the tube 200 and follows the flow path 172 illustrated in FIG. 4.

The air is directed along a convoluted pathway by a curved deflector wall 238, which extends below the baffle opening at least in the region of the baffle opening to partially surround the flap valve 215. The deflector wall has an opening 240, radially spaced about 180° from the baffle opening, to provide room for the flap valve to open. The air flows between the deflector wall 238 and the inside of the dirt cup to the baffle opening 236. A shelf 242, which extends laterally adjacent the lower end of the opening and a pair of vanes 244, extending from the inside of the dirt cup 208 assist in directing the air around the baffle vertical wall 234 and into the baffle opening 236. The convoluted air path causes much of the dirt and substantially all of the moisture in the air stream to drop out of the air stream into the dirt cup 208. This allows use of a fan and motor which are not specifically designed for use with air laden with water droplets. A further portion of the dirt, mostly dry dirt of a lighter weight, enters the opening 236 and collects in a well 246 defined between the base 235 of the baffle chamber 237 and the opening 236. Any remaining fine pieces of dirt carried through the baffle opening 236 in the air stream are trapped on the filter 224.

The baffle well 246 thus provides an additional dirt collecting region, which increases the dirt collection capacity of the dirt collection assembly. Once the level of dirt in the dirt cup 208 reaches about the level of the flap valve 215, it is desirable to empty the dirt cup and baffle chamber of collected dirt.

As shown in FIG. 2, during operation of the suction system, the dirt cup 208 is secured in place in the socket 80 by a latch mechanism 250 or other suitable conventional fastening mechanism. With reference now to FIG. 7, to remove the dirt cup 208, depression of a release button 251 of the latch mechanism 250 can release a spring biased tab 252 from a slot 254 (FIG. 12) formed in the outlet end of the dirt cup 208. It should be apparent from FIGS. 12 and 13 that the baffle 226 and dirt cup 208 can be keyed, as at 256, 257 so that the baffle only fits in the dirt cup in one orientation. Similarly, the filter member 220 can be keyed, as at 258, 259, for one way receipt into the baffle 226 so that the portion of the filter 224 exposed through the opening 236 is free of seams to maximize airflow (FIG. 13).

Figure 15:
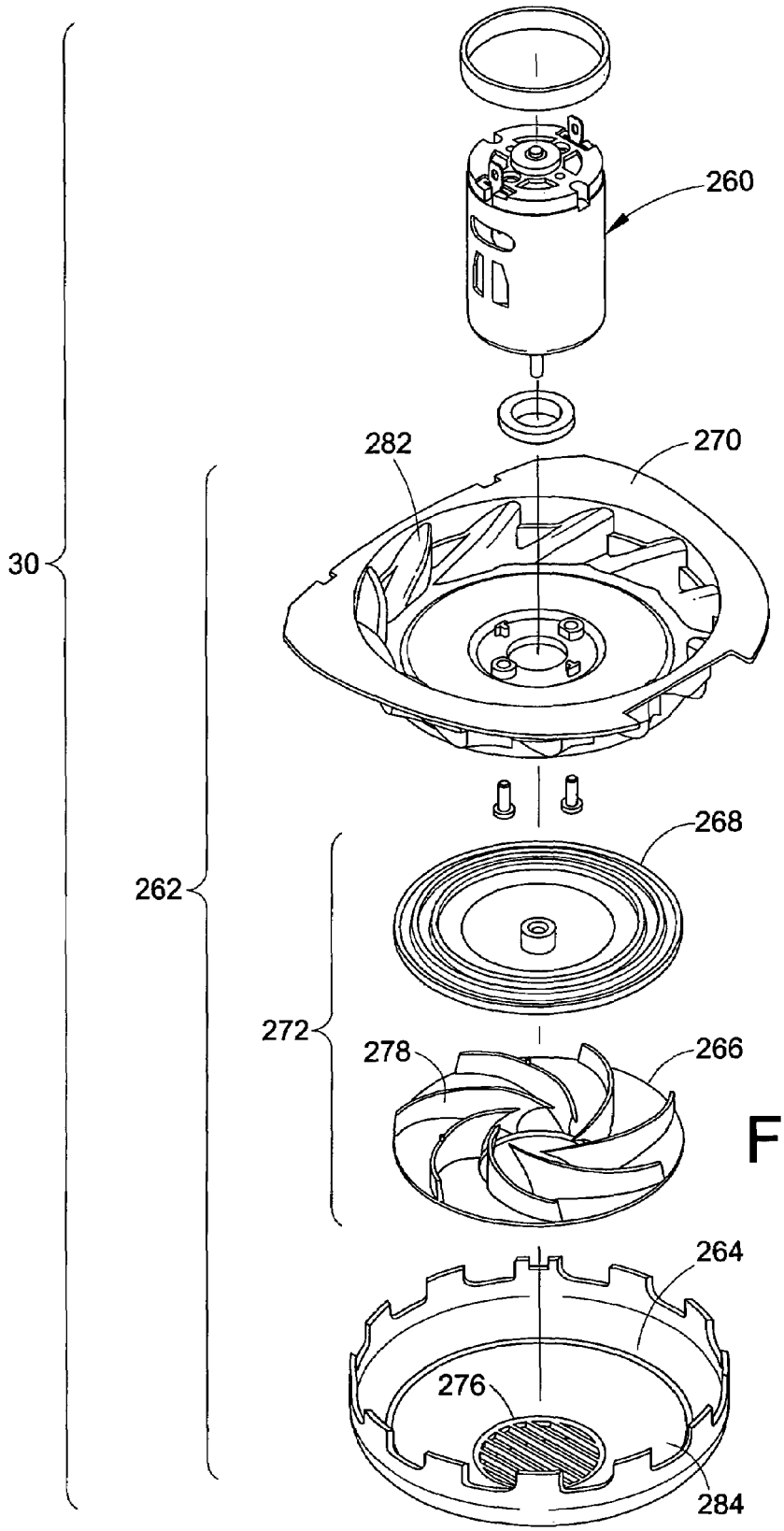
FIG. 15 is an enlarged exploded perspective view of a suction fan and motor assembly of the floor cleaning device of FIG. 1.

With reference now to FIG. 15, the fan and motor assembly 30 includes a motor 260 capable of operating on a dc voltage of about 7.2–9.6 volts DC, provided by the power source 34 (FIG. 7) and a fan assembly 262. The fan assembly includes a diffuser cover 264, fan cover 266, fan bottom 268, and radial diffuser 270 which are stacked together to form the fan assembly. The fan cover 266 and fan bottom 268 serve as an impeller 272, which is rotated by the motor 260 to create a suction force on the dirt cup 190, drawing air and dirt from the floor suction nozzle 18 into the dirt cup.

The air is drawn through the diffuser cover 264 via a central opening 276 therein and directed radially outwardly by vanes 278 on the fan cover 266. The radial diffuser 270 has a plurality of vanes 282 which are angled to direct the air flow outward. The air is directed through a plurality of arcuately spaced apertures or slots 284 in an upper end of the diffuser cover 264. This system provides an efficient means of directing the air stream away from the fan in a direction generally perpendicular to the axis of rotation of the fan. The fan is thus capable of operating on a relatively low-powered motor. It also reduces the possibility of moisture in the air coming into contact with the motor and causing damage.

With reference again to FIG. 4, when the fan motor assembly 30 is operational, the working air follows a short and efficient flow path. Dirt-laden air is drawn in through the suction inlet 170 of the suction nozzle and is carried upward along the short flexible hose 200 and exits out the dirt cup inlet 212, which is elevated, relative to the base of the dirt cup 208. Heavier dirt particles fall to the base of the dirt cup 208 under gravity. Any fluid in the airstream is separated out by the tortuous flow path around baffle 226, along with additional dirt or dust. Lighter particles may be drawn upward in through the baffle opening 236, where they are trapped on the filter 220 or in the baffle well 246 beneath the filter. Working air is drawn through the filter 220 by fan assembly 262, flows away from the motor 260, and is directed out of the housing by the fan and motor assembly 30 through suitably positioned louvers 286 therein (FIG. 7).

In place of the dirt cup 208 and filter assembly 218, another suitable conventional dirt collection assembly may be employed, such as a replaceable filter bag made from paper, cloth, or other porous material, a cyclonic flow dust separation system, or the like.

With reference to FIG. 2, a brush 290 or other suitable cleaning tool can be removably mounted to the handle assembly to aid in dislodging dirt which is too firmly adhered to the surface to be readily removed by the cleaning pad or suction nozzle alone. A lower hand grip 292 may be mounted to the handle sleeve 84 for ease of lifting the cleaning device.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A cleaning device comprising:

a handle assembly;

a cleaning head pivotally attached to a first end of said handle assembly and configured for receiving a replaceable cleaning pad for collecting dirt from a floor surface to be cleaned;

a spray nozzle mounted on one of said cleaning head and said handle assembly for delivering a cleaning fluid to a floor surface to be cleaned;

a liquid delivery system which delivers cleaning fluid to said spray nozzle, at least a portion of said liquid delivery system being carried by said handle assembly;

a suction nozzle carried by said cleaning head, the suction nozzle being movable between a floor suctioning position, in which the suction nozzle is positioned adjacent the floor surface to be cleaned and a retracted position, in which the suction nozzle is positioned away from the floor surface;

a dirt collection assembly for collecting dirt and in fluid communication with said suction nozzle, said dirt collection assembly being carried by one of said handle assembly and said cleaning head; and a source of suction, carried by one of said handle assembly and said cleaning head, said source of suction being fluidly connected with said dirt collection assembly, for creating a flow of working air which draws dirt from said suction nozzle into said dirt collection assembly.

2. The cleaning device of claim 1, wherein said dirt collection assembly includes a dirt cup which is removably mounted on said handle assembly.

3. The cleaning device of claim 1, wherein the suction nozzle is pivotably mounted to said cleaning head.

4. The cleaning device of claim 1, wherein the liquid delivery system includes a fluid supply pump.

5. The cleaning device of claim 1, further including a switch which is movable between a first position, for selectively actuating said source of suction, and a second position, wherein when said switch is in said second position, the flow of working air is stopped and the liquid delivery system is actuated.

6. The cleaning device of claim 1, wherein said cleaning head has a substantially flat lower surface.

7. The cleaning device of claim 6, wherein said cleaning pad is selectively mounted adjacent said lower surface.

8. The cleaning device of claim 1, wherein the spray nozzle is carried by the suction nozzle.

9. The cleaning device of claim 1, wherein said handle assembly includes an elongate handle and a housing mounted to said handle, said housing defining a socket for selectively receiving said dirt collection assembly.

10. The cleaning device of claim 1, further comprising a conduit extending between said suction nozzle and said dirt collecting assembly, wherein said conduit comprises a flexible hose.

11. The cleaning device of claim 1, wherein said spray nozzle is mounted to said suction nozzle.

12. A cleaning device comprising:

a handle assembly;

a cleaning head pivotally attached to a first end of said handle assembly and configured for receiving a replaceable cleaning pad for collecting dirt from a floor surface to be cleaned;

a spray nozzle mounted on one of said cleaning head and said handle assembly for delivering a cleaning fluid to a floor surface to be cleaned;

a liquid delivery system which delivers cleaning fluid to said spray nozzle, at least a portion of said liquid delivery system being carried by said handle assembly;

a suction nozzle carried by said cleaning head;

a dirt collection assembly for collecting dirt and in fluid communication with said suction nozzle, said dirt collection assembly being carried by one of said handle assembly and said cleaning head;

a source of suction, carried by one of said handle assembly and said cleaning head, said source of suction being fluidly connected with said dirt collection assembly, for creating a flow of working air which draws dirt from said suction nozzle into said dirt collection assembly; and a switch which is movable between a first position, for selectively actuating said source of suction, and a second position, wherein when said switch is in said second position, the flow of working air is stopped and the liquid delivery system is actuated.

13. The cleaning device of claim 12, wherein the suction nozzle is movable between a floor suctioning position, in which the suction nozzle is positioned adjacent the floor surface to be cleaned and a retracted position, in which the suction nozzle is positioned away from the floor surface.

14. The cleaning device of claim 12, wherein said switch is movable to an intermediate position between said first and second positions.

15. The cleaning device of claim 14, wherein said switch is biased to said intermediate position.

16. The cleaning device of claim 12, wherein said dirt collecting assembly comprises a dirt cup.

17. The cleaning device of claim 16, wherein said dirt collecting receptacle further comprises a baffle and a filter member.

18. The cleaning device of claim 17, wherein said baffle is removably mounted in said dirt cup.

19. A cleaning device comprising:

a handle assembly;

a cleaning head pivotally attached to a first end of said handle assembly and configured for receiving a replaceable cleaning pad for collecting dirt from a floor surface to be cleaned;

a multiple axis joint which interconnects said cleaning head and said handle assembly;

a spray nozzle mounted on one of said cleaning head and said handle assembly for delivering a cleaning fluid to a floor surface to be cleaned;

a liquid delivery system which delivers cleaning fluid to said spray nozzle, at least a portion of said liquid delivery system being carried by said handle assembly;

a suction nozzle carried by said cleaning head;

a dirt collection assembly for collecting dirt and in fluid communication with said suction nozzle, said dirt collection assembly being carried by one of said handle assembly and said cleaning head; and a source of suction, carried by one of said handle assembly and said cleaning head, said source of suction being fluidly connected with said dirt collection assembly, for creating a flow of working air which draws dirt from said suction nozzle into said dirt collection assembly.

20. A cleaning device comprising:

a handle assembly;

a cleaning head pivotally attached to a first end of said handle assembly and configured for receiving a replaceable cleaning pad for collecting dirt from a floor surface to be cleaned;

a spray nozzle attached to an upper surface of said cleaning head for delivering a cleaning fluid to a floor surface to be cleaned;

a liquid delivery system which delivers cleaning fluid to said spray nozzle, at least a portion of said liquid delivery system being carried by said handle assembly;

a suction nozzle carried by said cleaning head;

a dirt collection assembly for collecting dirt and in fluid communication with said suction nozzle, said dirt collection assembly being carried by one of said handle assembly and said cleaning head; and a source of suction, carried by one of said handle assembly and said cleaning head, said source of suction being fluidly connected with said dirt collection assembly, for creating a flow of working air which draws dirt from said suction nozzle into said dirt collection assembly.

21. A cleaning device comprising:

a housing;

a suction fan and motor assembly mounted to said housing;

a cleaning head pivotally mounted to said housing, said cleaning head selectively holding a cleaning pad for collecting dust and debris from a surface to be cleaned;

a suction nozzle carried by said cleaning head;

a dirt collecting receptacle mounted to said housing and in fluid communication with said suction nozzle and said suction fan and motor assembly;

at least one spray nozzle mounted to said suction nozzle; and a liquid delivery system for delivering a cleaning fluid to said at least one spray nozzle, wherein at least a portion of said liquid delivery system is mounted on said housing.

22. The cleaning device of claim 21, wherein said dirt collecting receptacle comprises a dirt cup.

23. The cleaning device of claim 22, further comprising a latch for selectively securing said dirt cup to said housing.

24. The cleaning device of claim 22, wherein said dirt cup comprises an inlet and an outlet, wherein said inlet communicates with an outlet of said suction nozzle and said dirt cup outlet communicates with an inlet of said suction fan and motor assembly.

25. The cleaning device of claim 22, further comprising a filter detachably mounted to said dirt cup.

26. The cleaning device of claim 25, further comprising a baffle mounted in said dirt cup intermediate said filter and said dirt cup.

27. The cleaning device of claim 21, wherein said cleaning head is pivotably connected to said housing via a universal joint.

28. The cleaning device of claim 21, wherein said cleaning head is generally rectangular with a generally flat bottom surface.

29. The cleaning device of claim 21, further comprising at least one battery mounted to said housing for powering said suction fan and motor.

30. The cleaning device of claim 21, wherein said cleaning head comprises a bottom surface including at least one securing member for securing said cleaning pad to said cleaning head.

31. The cleaning device of claim 21, wherein said cleaning head includes a support plate, said support plate being pivotally connected with said housing and carrying said spray nozzle and said suction nozzle on an upper surface thereof.

32. The cleaning device of claim 21, wherein said suction nozzle is movably mounted to said cleaning head, said spray nozzle moving as the suction nozzle is moved.

33. The cleaning device of claim 21, wherein the suction nozzle is movable between a suctioning position, in which said suction nozzle is positioned adjacent to a surface to be cleaned, and a retracted position, in which said suction nozzle is spaced away from said surface.

34. The cleaning device of claim 33, wherein the suction nozzle includes first and second arms which are pivotally mounted to the cleaning head adjacent distal ends thereof, at least one of the arms having a first indent and a second indent for selectively engaging a detent associated with the cleaning head, such that when the first indent engages the detent, the suction nozzle is positioned adjacent to a surface to be cleaned, and when the second indent engage the detent, the suction nozzle is positioned in the retracted position.

35. The cleaning device of claim 21, further comprising a handle mounted to said housing.

36. The cleaning device of claim 35, further comprising a switch located on said handle for controlling an actuation of at least one of said suction fan and motor assembly and said fluid distribution system.

37. The cleaning device of claim 36, wherein said switch has a first position in which said suction fan and motor assembly is actuated and said fluid delivery system is disabled and a second position in which said fluid delivery system is actuated and said suction fan and motor assembly is disabled.

38. A cleaning device comprising:

a housing;

a suction fan and motor assembly mounted to said housing;

a cleaning head pivotally mounted to said housing, said cleaning head selectively holding a cleaning pad for collecting dust and debris from a surface to be cleaned;

a suction nozzle carried by said cleaning head;

a dirt collecting receptacle mounted to said housing and in fluid communication with said suction nozzle and said suction fan and motor assembly;

at least one spray nozzle carried by one of said cleaning head and said handle assembly for delivering a cleaning fluid to a floor surface to be cleaned;

a conduit extending between said suction nozzle and said dirt collecting receptacle, said conduit comprising a flexible hose; and a liquid delivery system for delivering a cleaning fluid to said at least one spray nozzle, wherein at least a portion of said liquid delivery system is mounted on said housing.

39. A cleaning device comprising:

a cleaning head selectively holding a cleaning pad;

a handle for directing said cleaning head along a surface to be cleaned;

a housing mounted to at least one of said handle and said cleaning head;

a suction fan and motor assembly mounted to said housing;

a dirt collecting receptacle mounted to said housing said dirt collecting receptacle comprising a dirt cup, a baffle, and a filter member, said baffle being removably mounted in said dirt cup;

a suction nozzle fluidly connected with said dirt collecting receptacle; and a liquid delivery system mounted to at least one of said housing and said suction nozzle for delivering a cleaning solution to the surface to be cleaned, the liquid delivery system including a spray nozzle carried by one of the suction nozzle, the handle, and the cleaning head.

40. The cleaning device of claim 39, wherein said filter member is removably mounted to said baffle.

41. The cleaning device of claim 39, further comprising a switch for alternatively actuating said suction fan and motor assembly and said liquid delivery system.

42. A cleaning device comprising:

a housing;

a suction nozzle communicating with said housing;

a suction fan and motor assembly mounted to said housing;

a dirt collecting receptacle mounted to said housing and in fluid communication with said suction nozzle and said suction fan and motor assembly;

a liquid delivery system mounted to said housing for delivering a cleaning solution to a surface to be cleaned;

a handle mounted to said housing for grasping to move said cleaning device along the surface to be cleaned;

a switch for actuating at least one of said suction fan and motor assembly and said liquid delivery system, said switch having a first position and a second position, said liquid delivery system being inoperative while said switch is in said first position and operated while said switch is in said second position; and a cleaning head pivotally mounted to said housing, said cleaning head selectively holding a cleaning pad for collecting dust and debris from a surface to be cleaned.

43. The cleaning device of claim 42, wherein said switch is located on said handle.

44. The cleaning device of claim 43, wherein said suction fan and motor assembly are operated only while said switch is moved to a first position.

45. The cleaning device of claim 44, wherein said liquid delivery system is operated only while said switch is moved to a second position.

46. The cleaning device of claim 45, wherein the fluid delivery system includes a pump which is actuated by said switch in said second position.

47. The cleaning device of claim 45, wherein said switch is biased to a third, off, position between said first and second positions.

48. A cleaning device comprising:

two separate and distinct modes of operation, wherein a first mode of operation comprises suctioning debris from a surface to be cleaned, and a second mode of operation comprises application of a cleaning liquid to the surface, a cleaning pad being used to collect dirty cleaning liquid and dust and debris from the surface to be cleaned, wherein said two modes of operation are mutually exclusive, said cleaning device comprising:

a housing;

a suction fan and motor assembly mounted to said housing;

a dirt collecting receptacle mounted to said housing;

a suction nozzle fluidly connected with said suction fan and motor assembly and said dirt collecting receptacle for performing said first mode of operation;

a liquid delivery system mounted at least in part to said housing for delivering a cleaning liquid to the surface during said second mode of operation; and, a cleaning head pivotally mounted to said housing, said cleaning head selectively holding said cleaning pad used during said second mode of operation.

49. A cleaning device having a liquid delivery system for cleaning a surface, comprising:

an elongate handle assembly having first and second ends;

a cleaning head pivotally mounted to said first end of said handle assembly;

a cleaning pad mounted to said cleaning head for collecting dirty cleaning liquid and dust and debris from a surface to be cleaned;

a suction nozzle carried by one of said cleaning head and said elongate handle assembly and pivotable between a first position, in which the nozzle is located adjacent the surface to be cleaned, and a second position, in which the nozzle is spaced away from the surface to be cleaned;

a spray nozzle for spraying liquid from said liquid delivery system in a first cleaning mode, said spray nozzle being mounted to one of said cleaning head, said handle, and said suction nozzle, said suction nozzle being used in a second cleaning mode of the cleaning device;

a suction motor/fan assembly fluidly connected to said suction nozzle; and a filter chamber fluidly connected to both said suction nozzle and said suction motor/fan assembly.

50. The cleaning device of claim 49, wherein said cleaning head is pivotally mounted to said first end by a universal joint such that said cleaning head is pivotable relative to said housing about first and second axis.

51. The cleaning device of claim 49, further including a latch which engages the suction nozzle in at least one of said first and second positions.

52. A method of cleaning a surface with a device comprising a handle assembly and a cleaning head pivotally attached to said handle assembly, the method comprising:

applying a cleaning solution to the surface from a liquid delivery system at least partially mounted on said handle assembly to a spray nozzle carried by said suction nozzle; and directing the cleaning head over the surface with the handle assembly such that dirty cleaning solution from the surface is transferred to the cleaning head; and selectively suctioning dirt and dirty cleaning solution from the surface through a suction nozzle attached to one of said cleaning head and said handle assembly;

moving the suction nozzle to a position away from the floor surface; and fitting a cleaning pad to the cleaning head.

53. The method of claim 52, wherein the suctioning and applying steps are controlled by a switch, the suctioning step including the subsidiary step of moving the switch to a first position which causes suction to be applied to the suction nozzle and prevents the liquid delivery system from applying cleaning solution to the surface, and the applying step including the subsidiary step of moving the switch to a second position in which the suction is not applied to the suction nozzle and causes the liquid delivery system to apply cleaning solution to the surface.

54. A cleaning device comprising:

a suction nozzle;

a dirt collection assembly for collecting dirt and in fluid communication with said suction nozzle, the dirt collection assembly including:

a dirt cup configured for collecting a first portion of the dirt, a baffle received within the dirt cup, the baffle providing a tortuous path for air and entrained dirt, the baffle defining a dirt receiving region configured for collecting a second portion of the dirt, and a filter received within the dirt cup;

a source of suction, fluidly connected with said dirt collection assembly, for creating a flow of working air which draws dirt from said suction nozzle into said dirt collection assembly such that a first portion of the dirt is collected in said dirt cup, and a second portion of the dirt is collected in the baffle receiving region, and a remaining portion of the dirt is removed by said filter;

a cleaning pad, a reservoir for containing a cleaning solution, and a cleaning solution delivery system.

55. The cleaning device of claim 54, wherein the baffle defines a chamber with an opening through which the air and entrained dirt enters the chamber, and wherein the collection region includes a well at a lower end of the chamber, said well comprising said dirt receiving region.

56. The cleaning device of claim 54, further including an actuation system for selectively actuating said cleaning solution delivery system and source of suction.

* * * * *